US007108071B2

(12) United States Patent
Freiheit et al.

(10) Patent No.: US 7,108,071 B2
(45) Date of Patent: Sep. 19, 2006

(54) AUTOMATIC TUBING FILLER

(75) Inventors: Roland Richard Freiheit, Edmonton (CA); James Frederick Wilkin, Sherwood Park (CA); Geoffrey David Steele, Edmonton (CA)

(73) Assignee: Weatherford/Lamb, Inc., Houston, TX (US)

( * ) Notice: Subject to any disclaimer, the term of this patent is extended or adjusted under 35 U.S.C. 154(b) by 431 days.

(21) Appl. No.: 10/135,632

(22) Filed: Apr. 30, 2002

(65) Prior Publication Data

US 2002/0189814 A1 Dec. 19, 2002

(51) Int. Cl.
*E21B 34/14* (2006.01)
*E21B 34/08* (2006.01)

(52) U.S. Cl. ..... 166/373; 166/323; 166/324; 166/334.4; 166/383; 166/386

(58) Field of Classification Search ..... 166/374, 166/373, 316, 319, 323, 332.1, 320, 386, 166/383, 334.4, 324; 175/317
See application file for complete search history.

(56) References Cited

U.S. PATENT DOCUMENTS

| | | | | | |
|---|---|---|---|---|---|
| 2,642,140 | A | * | 6/1953 | Brown | 166/327 |
| 2,698,054 | A | * | 12/1954 | Brown et al. | 166/381 |
| 2,847,074 | A | * | 8/1958 | Maly et al. | 166/325 |
| 3,687,202 | A | | 8/1972 | Young et al. | 166/305 |
| 3,850,250 | A | | 11/1974 | Holden et al. | |
| 3,970,147 | A | * | 7/1976 | Jessup et al. | 166/374 |
| 4,113,012 | A | | 9/1978 | Evans et al. | |
| 4,178,992 | A | | 12/1979 | Regan et al. | 166/117.6 |
| 4,324,293 | A | | 4/1982 | Hushbeck | 166/317 |
| 4,429,741 | A | | 2/1984 | Hyland | 166/63 |
| 4,453,599 | A | * | 6/1984 | Fredd | 166/374 |
| 4,609,005 | A | | 9/1986 | Upchurch | 137/68.1 |
| 4,625,762 | A | | 12/1986 | Hassanzadeh et al. | 137/624.27 |
| 4,651,818 | A | | 3/1987 | Johnson et al. | 166/115 |
| 4,984,631 | A | | 1/1991 | Reesing | 166/115 |
| 5,156,207 | A | * | 10/1992 | Haugen et al. | 166/142 |
| 5,343,956 | A | | 9/1994 | Coronado | 166/387 |
| 5,366,010 | A | | 11/1994 | Zwart | 166/120 |
| 5,411,049 | A | | 5/1995 | Colvard | 137/71 |
| 5,441,111 | A | | 8/1995 | Whiteford | 166/387 |
| 5,464,063 | A | | 11/1995 | Boehm, Jr. | 166/382 |
| 5,509,476 | A | | 4/1996 | Vick, Jr. | 166/75.13 |
| 5,542,475 | A | | 8/1996 | Turner et al. | 166/387 |
| 5,609,178 | A | | 3/1997 | Hennig et al. | |
| 5,685,372 | A | | 11/1997 | Gano | 166/292 |
| 5,727,632 | A | | 3/1998 | Richards | 166/387 |

(Continued)

FOREIGN PATENT DOCUMENTS

EP 0 939 193 9/1999

(Continued)

OTHER PUBLICATIONS

PCT Written Opinion, International Application No. PCT/GB02/01966, dated May 27, 2003.

(Continued)

*Primary Examiner*—Kenneth Thompson
(74) *Attorney, Agent, or Firm*—Patterson & Sheridan, LLP

(57) ABSTRACT

Methods and apparatus for filling a tubing string as it is lowered into a subterranean hydrocarbon well. In one embodiment, an apparatus to fill a tubular with fluid in a wellbore comprises a housing defining a central bore. An aperture formed in the housing provides fluid communication between the central bore and the ambient environment of the tubing string. A piston valve slidingly disposed in the housing is selectively pressure actuatable relative to the housing to control fluid communication between the central bore and the ambient environment.

25 Claims, 22 Drawing Sheets

U.S. PATENT DOCUMENTS

| | | | | |
|---|---|---|---|---|
| 5,765,641 | A | 6/1998 | Shy et al. | 166/292 |
| 5,979,553 | A | 11/1999 | Brink | 166/250.08 |
| 6,059,038 | A | 5/2000 | Vick, Jr. | 166/319 |
| 6,123,151 | A | 9/2000 | Regan et al. | 166/367 |
| 6,230,811 | B1 * | 5/2001 | Ringgenberg et al. | 166/374 |
| 6,508,309 | B1 * | 1/2003 | French | 166/323 |

FOREIGN PATENT DOCUMENTS

| | | |
|---|---|---|
| GB | 2 268 770 | 1/1994 |
| WO | WO 01/06086 | 1/2001 |

OTHER PUBLICATIONS

PCT International Search Report from International Application No. PCT/GB02/01966, dated Jul. 19, 2002.

* cited by examiner

AUTOMATIC TUBING FILLER

BACKGROUND OF THE INVENTION

1. Field of the Invention

The present invention generally relates to methods and apparatus utilized in subterranean wells. More particularly, the invention relates to methods and apparatus to control fluid flow between a tubing string bore and an ambient region.

2. Description of the Related Art

Extracting hydrocarbons from subterranean formations typically involves running a tubular string into a well. Illustrative tubular strings include work strings, completion strings and production string. Some operations subsequent to (or during) running a tubular string into a wellbore, require the presence of fluid in the tubular string. To this end, it is advantageous for fluid in the wellbore to enter the tubular string as the tubular string is being lowered into the wellbore. If unrestricted fluid communication exists between the bore formed by the tubular string and the annulus formed between the tubular string and the wellbore, fluid pressure in the tubular string bore and the annulus may be equalized, thereby facilitating some operations.

In general, the tubular string bore may be filled with fluid either by flowing fluid into the bore from the wellbore surface, or by allowing fluid already in the wellbore (which is typically present after drilling) to flow into the tubular string bore via an opening in the sidewall of the tubular string. However, filling the tubular string bore with fluid from the wellbore surface is typically not desirable. Therefore, it is preferable to fill the tubular string bore with fluid from the annulus.

While the tubular string bore may be filled with fluid from the annulus simply by providing an opening at a lower end of the tubular string bore, it is often desirable to maintain a degree of control over fluid flow between the annulus and the tubular string bore. Such control may be advantageous, for example, to pressure test the tubular string periodically as it is being run in the well. However, if the tubular string is open-ended or is otherwise open to fluid communication with the annulus, it may be difficult or uneconomical to periodically close off the opening so that a pressure test may be performed, and then reopen the tubular string so that it may continue to fill while it is lowered further in the well. Additionally, when other items of equipment are pressure tested, such as after setting a packer, it may be advantageous to permit fluid flow through the opening in the tubular string. Furthermore, after the tubular string has been installed and various subsequent operations (e.g., pressure testing) concluded, it is sometimes advantageous to prevent or restrict fluid flow through the tubular string sidewall. For example, after a production tubing string has been installed it may be desirable to close off any opening through the tubing string sidewall, except at particular locations, so that hydrocarbons may be extracted.

Accordingly, there is a need for the ability to control fluid flow between the annulus and the interior tubular string bore. Preferably, control may be maintained whether the desired form is from the annulus to the tube string bore or vise versa.

SUMMARY OF THE INVENTION

The present invention generally relates to a method and apparatus utilized in subterranean wells. More particularly, the invention relates to methods and apparatus used to fill the tubing string as it is lowered into the subterranean hydrocarbon well.

In one embodiment, the apparatus to fill a tubular with fluid in a wellbore comprises a housing with a central bore, the housing having at least one aperture formed in a wall thereof. The aperture provides fluid communication between the central bore and a region exterior to the housing. A sleeve (piston valve) is slidingly disposed in the housing. The sleeve is selectively movable (in response to pressure) relative to the housing to control fluid communication between an interior and exterior of the housing. In operation, the movement of the sleeve is determined by a pressure differential between the central bore and the exterior region of the housing.

One embodiment provides a wellbore apparatus for filling a tube string. The apparatus comprises a tubular member defining at least a central bore and at least a first fluid port formed in a wall of the tubular member, wherein the first fluid port provides at least selective fluid communication between the central bore and an ambient environment of the tubular member; a piston valve slidingly disposed in the tubular member; and an actuating mechanism disposed at least partially on the piston valve; wherein the actuating member operates to move the piston valve axially relative to the tubular member from an open position to a closed position. In one embodiment, selective fluid flow is allowed from the central bore into the ambient environment of the tubular member as well as from the ambient environment of the tubular member into the central bore.

Another embodiment comprises a tubing string assembly configured to control fluid flow between an interior tubing string bore and an ambient environment. The tubing string assembly comprises a tubular member defining a first fluid port and a second fluid port, the first fluid port providing selective fluid communication between the interior tubing string bore and the ambient environment and a piston valve disposed within the tubular member and capable of reciprocal axial movement therethrough. The piston valve defines at least a first piston area at one end and a second piston area at a second end, the first piston area being relatively larger than the second piston area and, in combination with the tubular member and the piston areas, defines an internal chamber which fluidly communicates with the ambient environment via the second fluid port. The piston valve is pressure actuated, according to relative pressures on the respective piston areas, to be in one of an (i) open position, (ii) a closed and unlocked position and (iii) a closed and locked position; wherein the first fluid port is open in the open position so that fluid flow is permitted between the ambient environment and the interior tubing string bores and wherein the first fluid port is closed in the closed and unlocked position and in the closed and locked position; and wherein the piston valve may be pressure actuated from the closed and unlocked position to the open position by providing a relatively greater hydrostatic pressure in the ambient environment relative to the tubing string bore.

Another embodiment provides a wellbore apparatus, comprising a tubular member defining at least a central bore and at least a first fluid port formed in a wall of the tubular member, wherein the first fluid port provides at least selective fluid communication between the central bore and an ambient environment of the tubular member; and a piston valve slidingly disposed in the tubular member and defining a piston area differential between a pair of piston areas and further defining a volume between the tubular member and at least one of the pair of piston areas. The piston valve is selectively movable relative to the tubular member in response to a relative pressure on the pair of piston areas; wherein the piston valve is actuatable from a closed position, in which the first fluid port is obstructed by the piston valve, to an open position, in which the first fluid port is not obstructed by the piston valve.

Yet another embodiment provides a method, providing a tube filler apparatus comprising: (i) a tubular member defining at least a central bore and at least a first fluid port formed in a wall of the tubular member, wherein the first fluid port provides at least selective fluid communication between the central bore and an ambient environment of the tubular member; and (ii) a piston valve slidingly disposed in the tubular member. The method further comprises pressure actuating the piston valve in a first direction to place the piston valve in a closed position when an increasing relative hydrostatic pressure gradient from the central bore to the annulus exists; and pressure actuating the piston valve in a second direction to move the piston valve from the closed position into an open position when an increasing relative hydrostatic pressure gradient from the annulus to the central bore exists.

Still another embodiment provides a wellbore apparatus, comprising a tubular member defining at least a central bore and at least a first fluid port formed in a wall of the tubular member, wherein the first fluid port provides at least selective fluid communication between the central bore and an ambient environment of the tubular member; a piston valve slidingly disposed in the tubular member; and a pressure-responsive actuating mechanism disposed at least partially on the piston valve; wherein the pressure-responsive actuating member operates to move the piston valve axially relative to the tubular member from a closed position to an open position.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
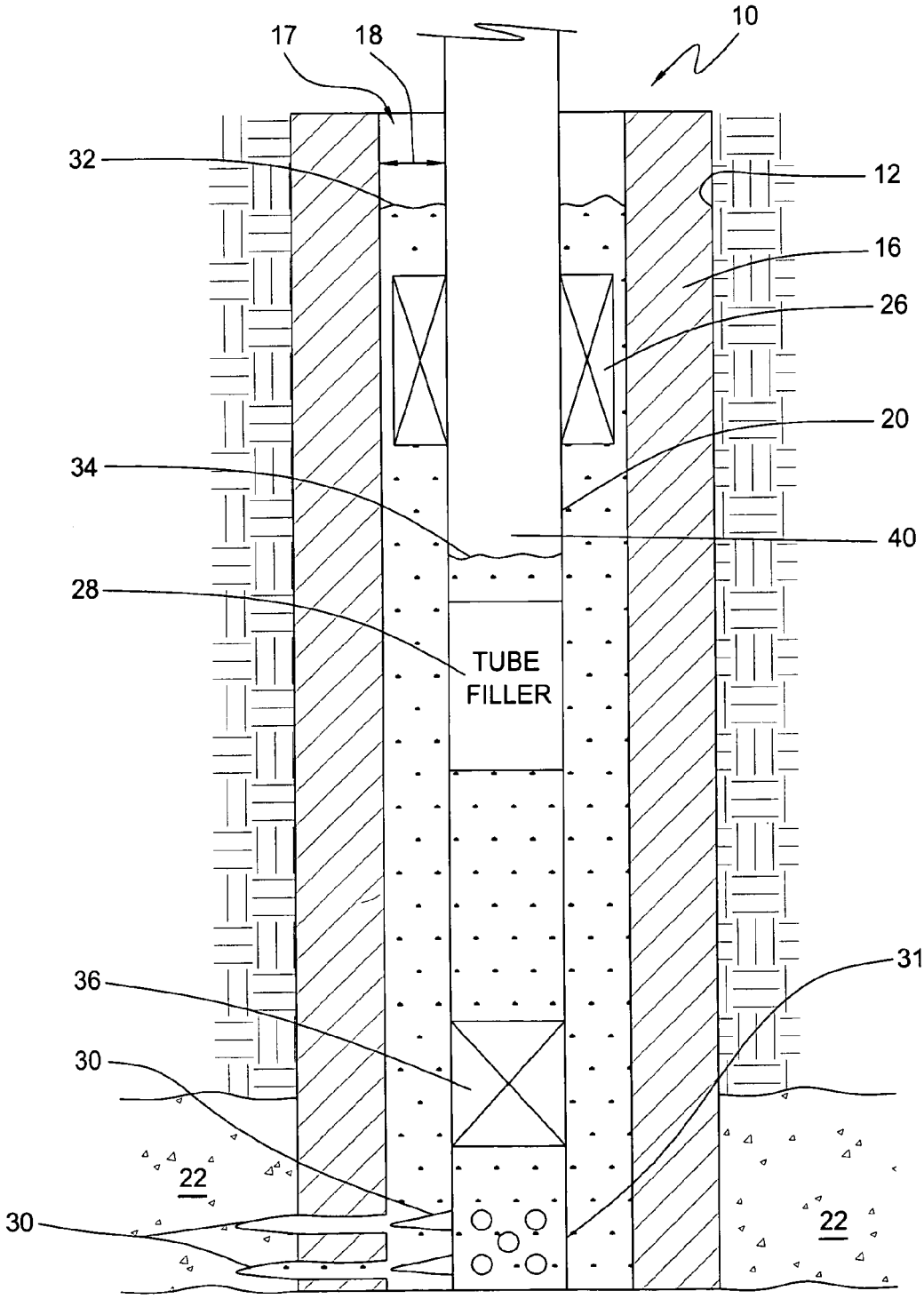
FIG. 1 is a cross-sectional side view of a wellbore having a tubular string of the present invention, in one embodiment, disposed therein. An automatic tube filler is seen in the wellbore. The tube filler selectively opens and closes in response to pressure differential caused by relative fluid levels within the tubing string and the surrounding annular region.

FIG. 1 is a cross-sectional view of a typical subterranean hydrocarbon well 10 which defines a vertical wellbore 12. In addition to the vertical wellbore 12, the well may include a horizontal wellbore (not shown) to more completely and effectively reach formations bearing oil or other hydrocarbons. In FIG. 1, wellbore 12 has a casing 16 disposed therein. After wellbore 12 is formed and lined with casing 16, a tubing string 20 is run into the opening 17 formed by the casing 16 to provide a pathway for hydrocarbons to the surface of well 10. Often, the well 10 has multiple hydrocarbon bearing formations, such as oil bearing formation 22 and/or gas bearing formations (not shown).

Illustratively, the tubing string 20 carries, or is made up of, an un-set packer 26, an automatic tubing filler 28, a tubing plug 36, and a perforation gun 31 in wellbore 12. Typically, the packer 26 is operated by either hydraulic or mechanical means and is used to isolate one formation from another. The packer 26 may seal, for example, an annular space formed between production tubing and the wellbore casing 16. Alternatively, the packer may seal an annular space between the outside of a tubular and an unlined wellbore. Common uses of packers include protection of casing from pressure and corrosive fluids; isolation of casing leaks, squeezed perforations, or multiple producing intervals; and holding of treating fluids, heavy fluids or kill fluids.

The automatic filling sub assembly 28 is threadedly attached to tubing string 20 and is used to allow fluid to enter and/or exit tubing string 20 as it is lowered into wellbore 12. Embodiments of the automatic filling sub assembly 28 will be described below.

The tubing string 20 is equipped with a tubing plug 36 at a lower end thereof. The tubing plug 36 may include a frangible portion disposed in its central bore. The plug 36 is used to seal the lower end of the tubing string 20 50 other downhole tools disposed on the tubing string 20 above the plug 36 may be operated using pressure applied within a bore 40 of the tubing string 20.

To recover hydrocarbons from the wellbore 12, perforations 30 are formed in casing 16 and in formation 22 to allow hydrocarbons to enter the casing opening 17. In the illustrative embodiment, the perforations 30 are formed through the use of a perforation gun 31. The perforating gun 31 is activated either hydraulically or mechanically and includes shaped charges constructed and arranged to perforate casing 16 and also formation 22 to allow the hydrocarbons trapped in the formations to flow to the surface of the well 10.

It is understood that the tubular string 20 shown in FIG. 1 is merely one configuration of a tubular string comprising the automatic tube filler 28. Persons skilled in the art will recognize that many configurations within the scope of the invention are possible.

In operation, the tube string 20 is run into the well for extraction of hydrocarbons. Generally, a wellbore remains filled with fluid after drilling, as represented by the fluid level 32 in FIG. 1. During the lowering of the tubing string 20 into wellbore 12, the fluid in an annulus 18 (defined as the region between the inner diameter of the casing 16 and the outer surface of the tube string 20) is displaced by tubing string 20. Since tubing string 20 is blocked at its lower end, fluid enters the tubing string 20 through the automatic tube filler 28.

At any given time, there may exist a height differential (i.e., head) between the fluid line 32 in the annulus 18 and a fluid line 34 in the string tube bore 40. Naturally, fluid has a tendency to flow in manner which will equilibrate the pressure differential. However, for the reasons given above, it is often desirable to control the flow of fluid between the annulus 18 and the tubing string bore. To this end, the automatic tube filler 28 is configured to be placed in an open position (allowing fluid flow from the annulus into the tubing string bore), a closed unlocked position (temporarily restricting or preventing fluid flow in either direction) and a closed locked position (permanently restricting or preventing fluid flow in either direction).

FIG. 1 illustrates an environment in which the fluid line 32 of the fluid in the annulus 18 is higher than the fluid line 34 of the fluid in the tubing string bore 40. In this case, the automatic tube filler 28 is generally in an open position, thereby allowing fluid flow from the annulus 18 into the tubing string bore 40. So long as fluid flow is permitted between the annulus 18 and tubing string bore 40, the existing pressure differential will cause the fluid level 32 in the annulus 18 to decrease and the fluid level 34 in the tubing string bore 40 to increase, relative to one another.

Figure 2:
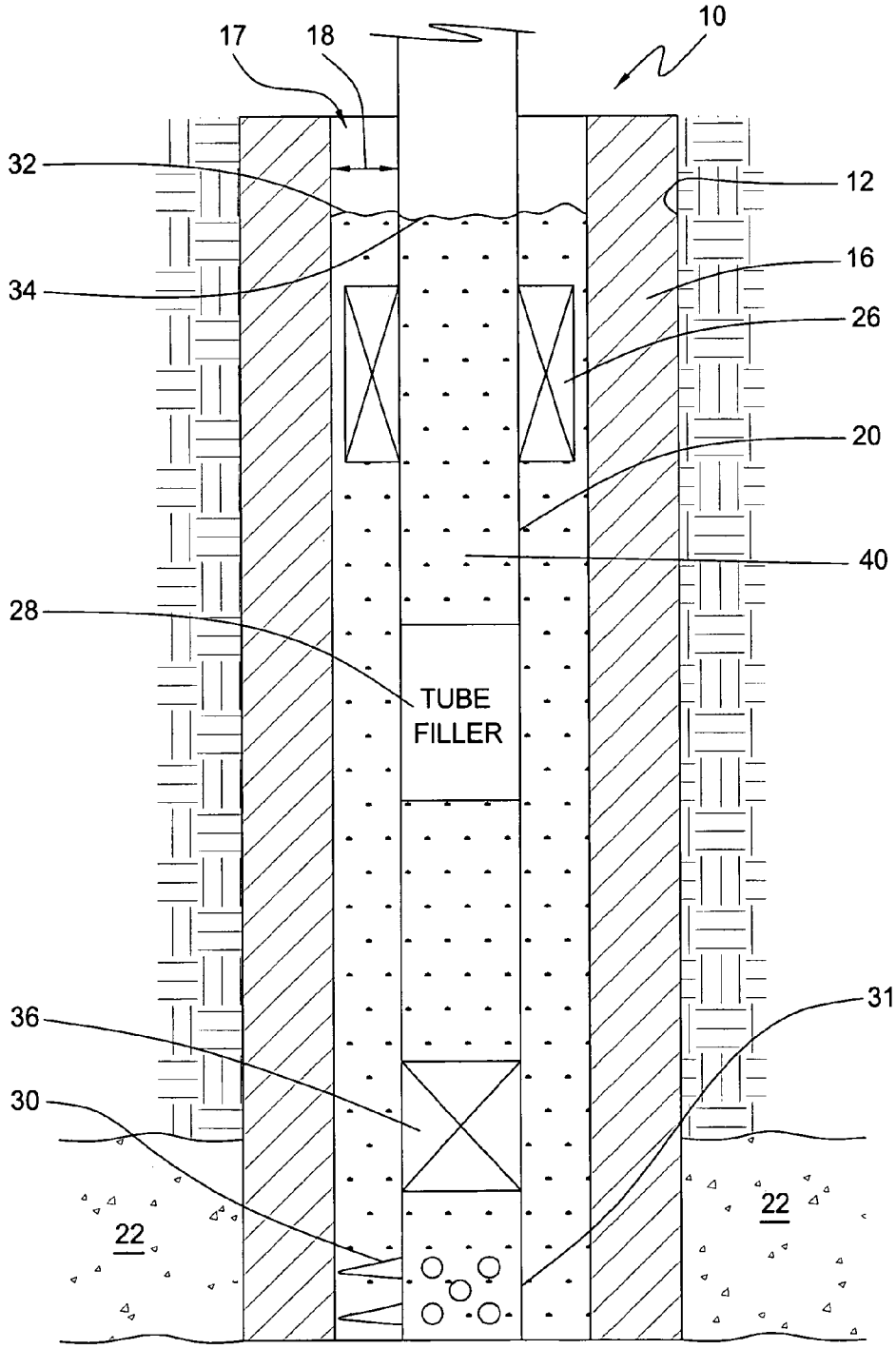
FIG. 2 is a side view of an embodiment of the tubular string of FIG. 1 in which fluid levels provide an equalized differential pressure such that the automatic tube filler is in a closed or open and equalized run-in position.
Figure 3:
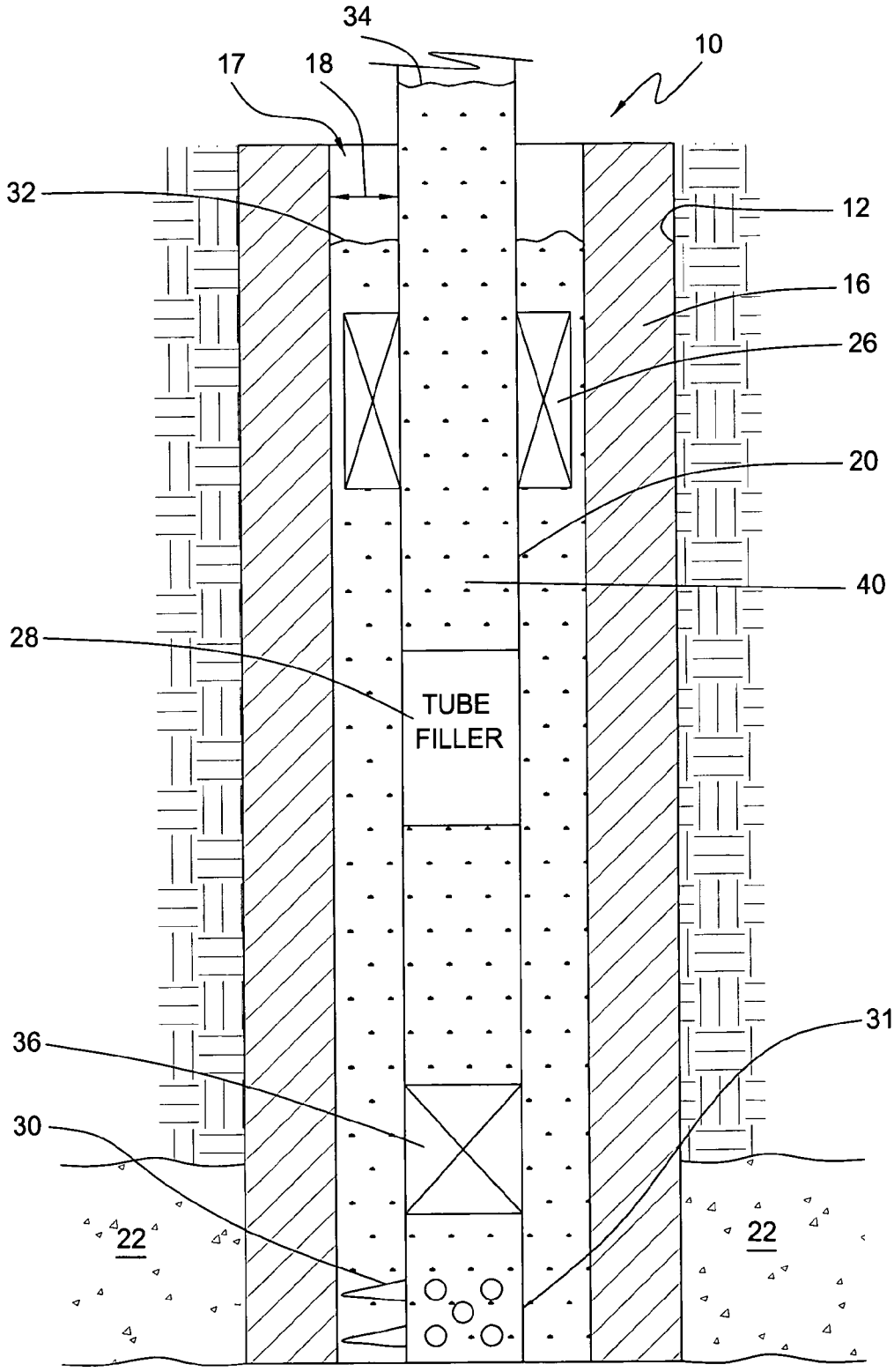
FIG. 3 is a side view of an embodiment of the tubular string of FIG. 1 in which fluid levels provide a differential pressure such that the automatic tube filler is in a closed or in a closed and locked position.

Assuming no fluids are being added, the fluid levels 32 and 34 will reach an equal height when the pressure differential is equalized, as illustrated in FIG. 2. In this state of equilibrium, the automatic tube filler 28 is configured so it can be in a closed (i.e., fluid flow between the annulus 18 and the tubing string bore 40 is prevented or restricted) and unlocked configuration. In one embodiment, the automatic tube filler 28 may be locked by creating a positive pressure within the tubing string bore 40 relative to the annulus 18. This may be done, for example, by flowing fluid into the tubing string bore 40 to increase the height of the fluid level 34 relative to the fluid level 32 in the annulus 18, as shown in FIG. 3. In one embodiment, increasing the relative pressure within the bore 40 overcomes the shear strength of one or more shear screws, thereby allowing engagement of a locking mechanism. One such locking mechanism is described below.

Figure 4A:
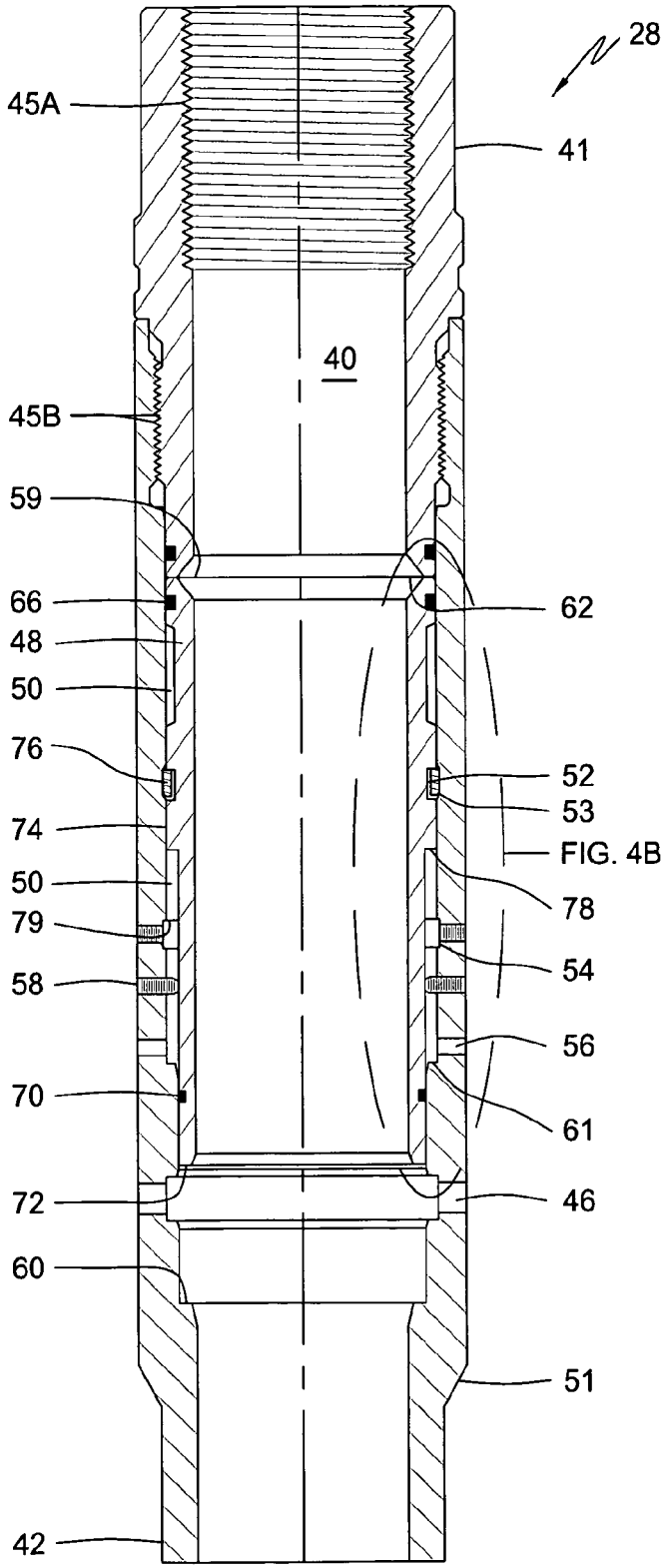
FIGS. 4A–B are cross-sectional views of an embodiment of an automatic tube filler in an open run-in position.
Figure 4B:
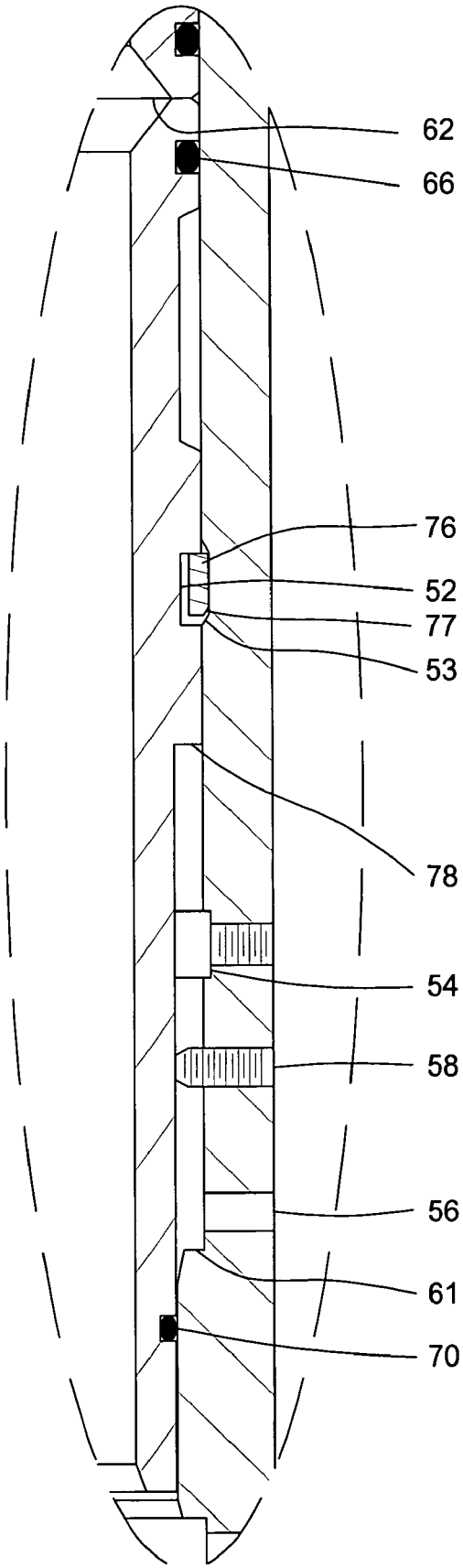

Referring now to FIGS. 4A and 4B (collectively referred to as FIG. 4), cross-sectional views of one embodiment of the automatic tube filler 28 is shown. FIG. 4A shows the automatic tube filler 28 generally, while FIG. 4B shows an enlarged portion of the automatic tube filler 28 taken from section lines denoted "FIG. 4B." This convention is used with respect to additional enlarged views in later drawings. In general, the automatic tube filler 28 comprises an upper sub 41, a lower sub 42, and a piston valve 48 (also referred to herein as a sleeve). The upper sub 41 includes inner threads 45A, whereby the automatic tube filler 28 is connected to the tubing string 20. The upper sub 41 and the lower sub 42 are coupled together by threads 45B. Together the subs 41, 42 define a generally tubular housing for receiving the piston valve 48. In the configuration of FIG. 4A, the upper sub 41, the lower sub 42 and piston valve 48 define a portion of the tubing string bore 40. It should be noted that while the upper sub 41, the lower sub 42 and piston valve 48 are each shown as singular pieces, they may each be made up of two or more pieces cooperating to function as a singular piece.

The lower sub 42 is generally sized to accommodate the axially reciprocating movement of the piston valve 48 therethrough. In the open position shown in FIG. 4, an upper surface of the piston valve 48 and a lower shoulder of the upper sub 41 are engaged, thereby preventing further upward axial movement of the piston valve 48.

In the illustrative embodiment of FIG. 4A, the piston valve 48 carries a first O-ring 66 and a second O-ring 70 at an upper end and a lower end, respectively. The O-rings 66, 70 maintain a seal with respect to the inner surface of the lower sub 42. In a region between the O-rings 66, 70, an intermediate chamber 50 is formed between the inner surface of the lower sub 42 and the piston valve 48. In general, the intermediate chamber 50 may be defined by one or more interstitial spaces in communication with one another. Further, the intermediate chamber 50 is in communication with the ambient environment (e.g., the annulus 18) via one or more fluid sensing ports 56.

The piston valve 48 also carries a split ring 76 (also referred to as a detent ring) in a groove 74 formed on its outer surface. In the open position illustrated in FIG. 4, the split ring 76 resides in a groove 52 (or detent) formed in the inner surface of the lower sub 42. When the piston valve 48 moves axially downward relative to the lower sub 42 (either under the weight of the piston valve 48 or by some applied force), a tapered edge 77 of the split ring 76 bears down on a tapered edge 53 of the groove 52. This configuration serves to inhibit the movement of the piston valve 48 and assist in holding the piston valve 48 in an open position under certain conditions. If a sufficient relative force exists, engagement with the tapered edge 53 will cause the split ring 76 to compress and allow the split ring 76 to move axially downward. Relative downward axial movement continues until a shoulder 78 of the piston valve 48 encounters one or more shear screws 58. The shear screws 58 are radially disposed within the lower sub 42, and a portion of the screws protrudes radially inward toward the piston valve 48.

Figure 5A:
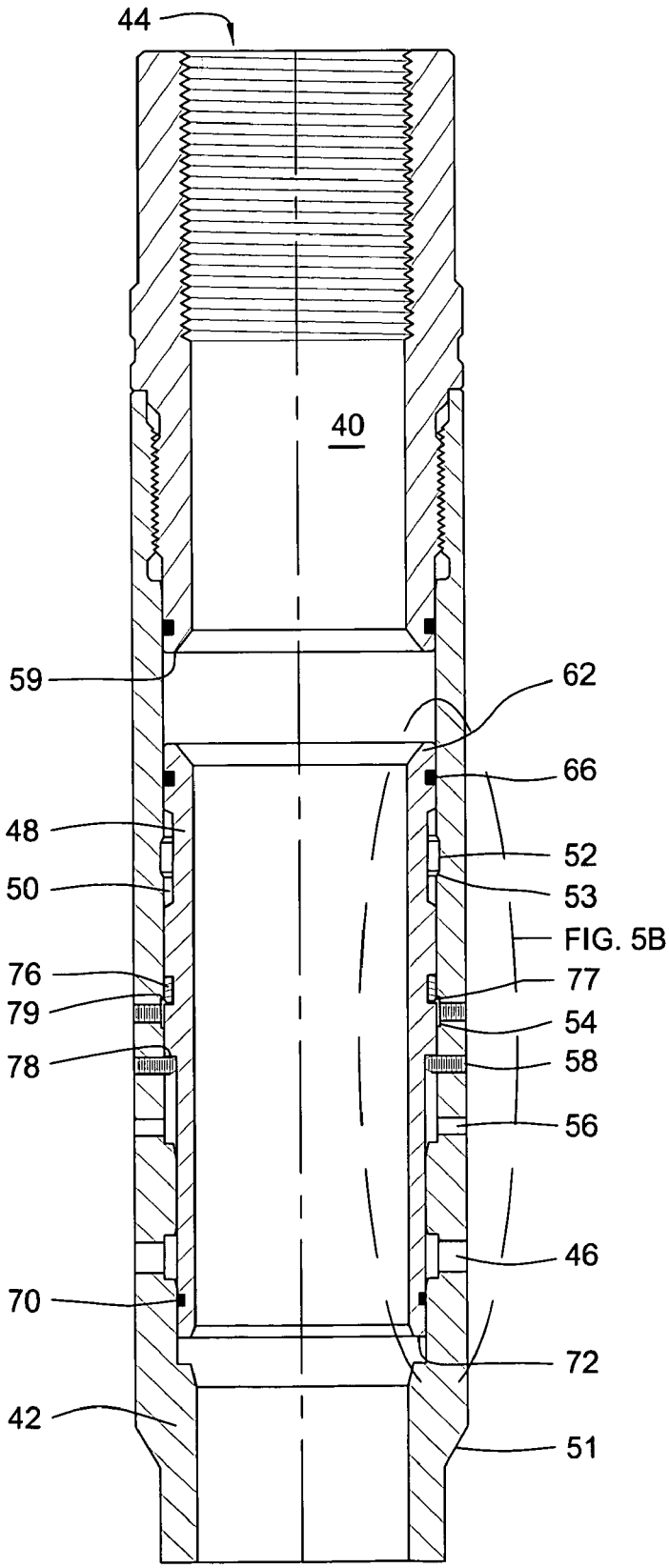
FIGS. 5A–B are cross-sectional views of an embodiment of the automatic tube filler in a closed position.
Figure 5B:
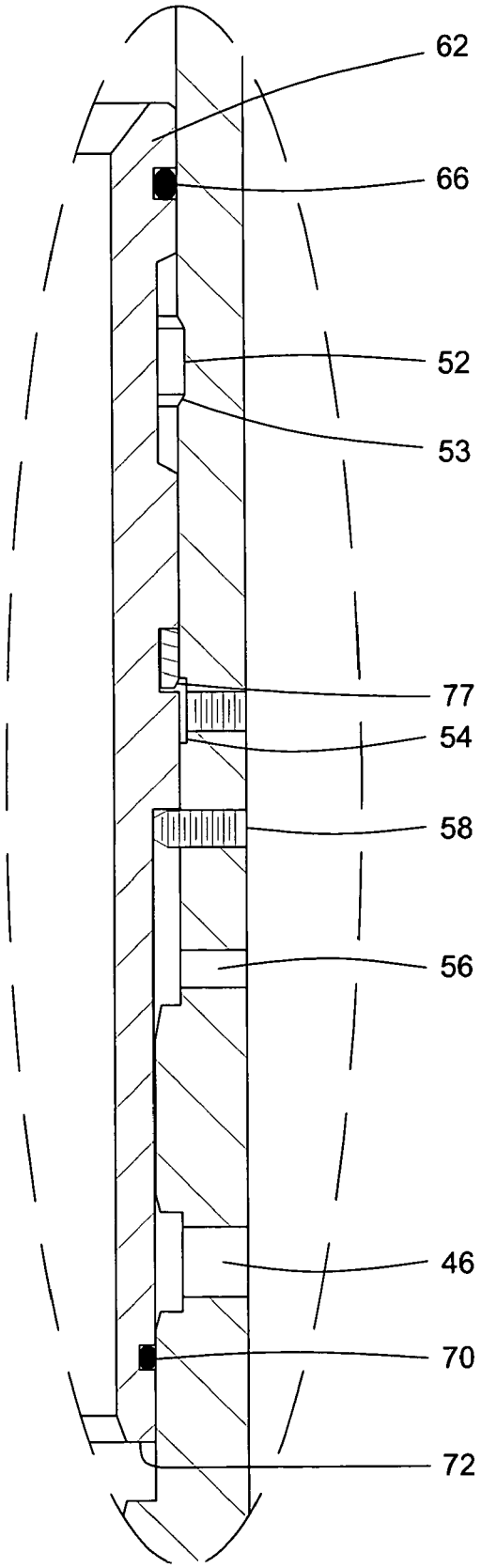

The position of the piston valve 48 upon encountering the shear screws 58 is referred to herein as the closed and unlocked position. This closed and unlocked position is illustrated in FIGS. 5A–B. In one aspect, the terms "open" and "closed" in this context characterizes the position of the piston valve 58 relative to a fluid port 46 formed at a lower end of the lower sub 42. In the "open" position, the fluid port 46 is open, thereby allowing fluid communication between an ambient environment (e.g., the annulus 18 shown in FIG. 1–3) and the tubing string bore 40. In the "closed" position, the fluid port 46 is closed, thereby preventing or restricting fluid communication between the ambient environment and tubing string bore 40.

Figure 6A:
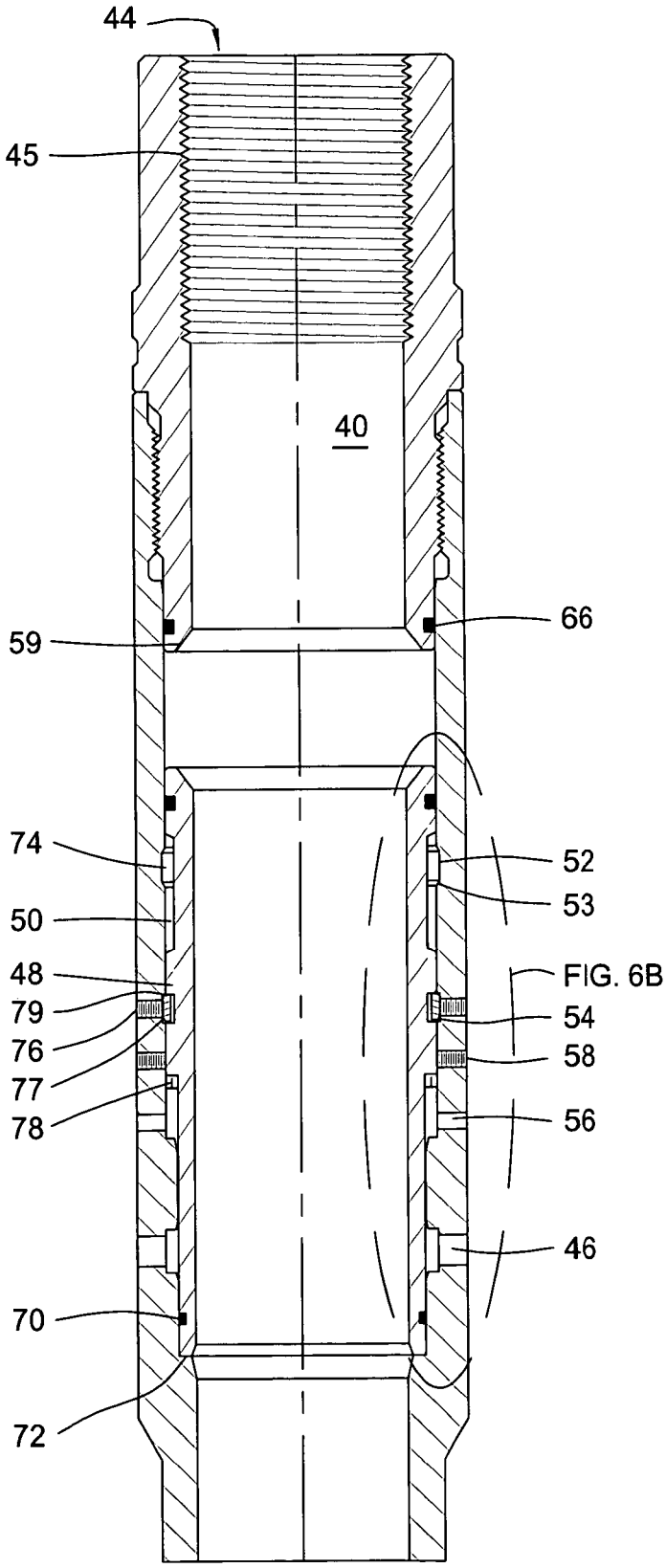
FIGS. 6A–B are cross-sectional views of an embodiment of the automatic tube filler in a closed and locked position.
Figure 6B:
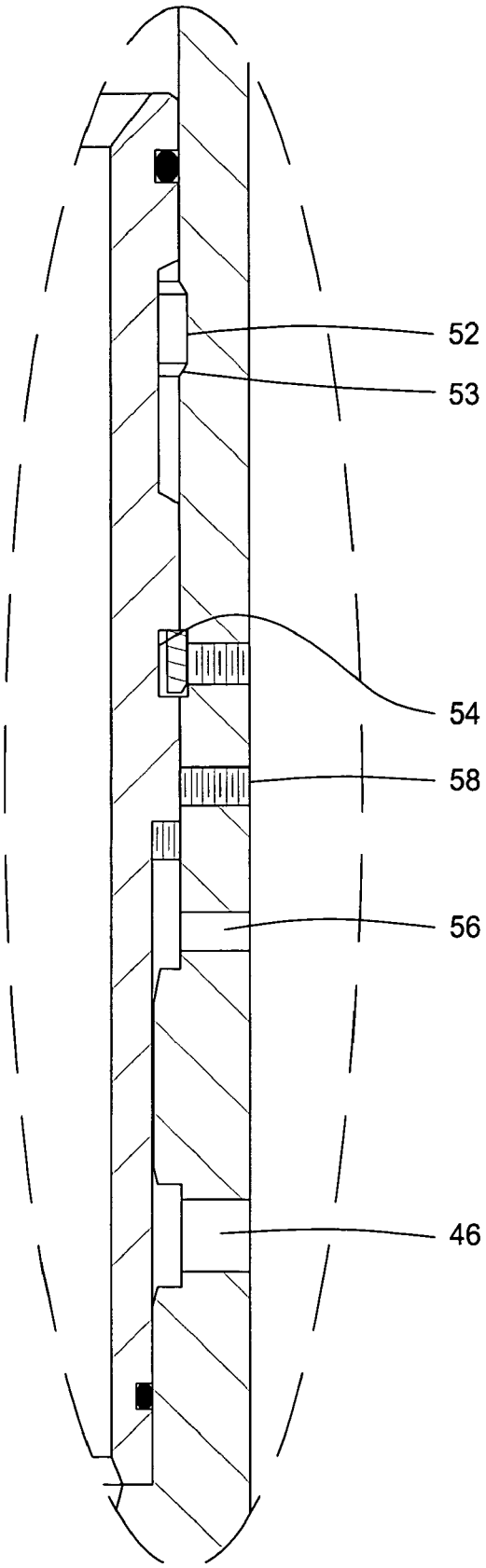

Each of the shear screws 58 have a shear strength which can be overcome by application of sufficient force. Upon application of such force, the shear screws 58 are sheared and the piston valve 48 continues traveling downward relative to the lower sub 42 until engaging a shoulder 60 72 formed at a lower end of the lower sub 42. The resulting position is referred to herein as closed and locked, and is illustrated in FIGS. 6A–B. In one aspect, the term "locked" refers to the position of the split ring 76 within the groove 54, which prevents the piston valve 48 from moving axially upward.

In operation, the piston valve 48 moves axially upward relative to the lower sub 42 when the hydrostatic fluid pressure in the intermediate chamber 50 (and therefore also the annulus 18) is greater than in the tubing string bore 40. Likewise, the piston valve 48 will also move downward to a closed position when the hydrostatic fluid pressure in the tubing string bore 40 is greater than the hydrostatic fluid pressure in the intermediate chamber 50. As will be described in more detail below, the mechanism by which this occurs is a piston area differential.

As tubing string 20 is lowered into wellbore 12, fluid level 32 in the annulus 18 is higher than fluid level 34 in the tubing string, as shown in FIG. 1. Because fluid port 46 is in the open position, as shown in FIGS. 4A–B, fluid from annulus 18 flows into the interior of the apparatus. Additionally, fluid from annulus 18 will flow into intermediate chamber 50 through fluid sensing port 56. As hydrostatic fluid pressure increases in annulus 18, an upward force is exerted on the piston area defined by the differential area between the area sealed by O-ring 66 and the area sealed by O-ring 70, thereby moving piston valve 48 upward and urging piston valve 48 to remain in the open position as shown in FIGS. 4A–B.

As piston valve 48 is moved in an upward direction, the shoulders 59 and 62 will engage to restrict any further displacement upward of piston valve 48. In addition, split-ring 76, which is disposed in recessed groove 52, will help to hold piston valve 48 in an open position if the tubing is jarred during running or other procedures. Thus, as tubing string 20 is lowered into wellbore 12, piston valve 48 of housing 44 will remain in an open position, as shown in FIGS. 4A–B, thereby allowing annulus fluid to continue to flow into tubing string bore 40 via the automatic filler tube 28.

The open position may be maintained, for example, while circulating a heavy fluid (not shown) into wellbore 12 before any subsequent downhole operations are performed in wellbore 12, such as setting packer 26. The heavy fluid, which is heavier than the hydrocarbons to be extracted from wellbore 12, is added into annulus 18 and circulated through the apparatus via fluid port 46. As the heavy fluid is added into annulus 18, hydrostatic fluid pressure in annulus 18 and intermediate chamber 50 increases relative to the hydrostatic fluid pressure in tubing string bore 40. As a result, the automatic filler tube 28 remains in the open position.

If the fluid level 34 in the tubing string bore 40 is allowed to increase relative to the fluid level 32 in the annulus 18, the hydrostatic pressure differential between the intermediate chamber 50 and tubing string bore 40 also equalizes. An equilibrium state is represented in FIG. 2 and FIGS. 5A–B.

Once the heavy fluid has been added and the hydrostatic fluid pressure in tubing string bore 40, annulus 18 and intermediate chamber 50 have equalized, it may be necessary to close piston valve 48 (as represented in FIGS. 5A–B) to operate other downhole tools, such as packer 26. To close piston valve 48, pressure in tubing string bore 40 is increased with respect to hydrostatic pressure in the annulus 18. A sufficient relative pressure differential operates to move piston valve 48 axially downward by virtue of the relatively greater hydrostatic pressure on the surface area of the O-ring 66 relative to the hydrostatic pressure on the surface area of the O-ring 70. By exerting a hydrostatic fluid pressure on the relatively larger surface area of O-ring 66 greater than the hydrostatic fluid pressure in the intermediate chamber 50, the annulus 18, and the bottom side of O-ring 70 (which has a relatively smaller surface area than O-ring 66), piston valve 48 will slidingly displace in a downward direction relative to lower sub 42. The hydrostatic fluid pressure needed to move piston valve 48 downward must be great enough to overcome the force needed to depress split-ring 76 by action of the tapered edge 53 against the tapered edge 77 of split-ring 76. As piston valve 48 is slidingly displaced in a downward direction, the tapered edge 77 of split-ring 76 is depressed by engagement with the tapered edge 53 of recessed groove 52 and allows piston valve 48 to slidingly displace axially downward until shoulder 78 formed on piston valve 48 engages shear screws 58. So long as the hydrostatic fluid pressure exerted on the surface area of O-ring 66 is not sufficient to for the shoulder 78 to break shear screws 58, piston valve 48 will be restricted from further movement downward. Thus, as hydrostatic fluid pressure is increased inside the tubing string bore 40 to displace piston valve 48 downward, as described, piston valve 48 will move to a closed position, as shown in FIGS. 5A–5B, and block fluid port 46. With the fluid port 46 closed, further fluid flow into tubing string bore 40 is prevented.

In some cases, it may be necessary to subsequently reopen fluid port 46 by displacing piston valve 48 in an upward direction to allow fluid to again enter tubing string bore 40 through fluid port 46. To displace piston valve 48 in an upward direction, fluid pressure is increased in annulus 18 relative to fluid pressure in the tubing string bore 40. By increasing the pressure in annulus 18, the relative hydrostatic fluid pressure increases in annulus 18 and intermediate chamber 50. Thus, as hydrostatic fluid pressure increases in annulus 18, a hydraulic force, created as annulus fluid flows into intermediate chamber 50 through fluid sensing port 56, is exerted on O-ring 66 of piston valve 48 displacing piston valve 48 upward. As piston valve 48 moves in an upward direction, split-ring 76 will expand to engage groove 54. At the same time, shoulder 62 of piston valve 48 will engage shoulder 59 of the upper sub 41, thereby restricting further movement upward of piston valve 48. Thus, fluid port 46 is reopened to allow fluid communication between the annulus 18 and the tubing string bore 40.

From the closed and unlocked position of the automatic filler tube 28 (shown in FIGS. 5A–B), it may be necessary to operate or test certain downhole tools such as packer 26, shown in FIG. 1. To operate packer 26, pressure must be increased in tubing string 20 in order to hydraulically or hydrostatically operate and set the packer 26. Assume, by way of illustration, the pressure needed to temporarily close the piston valve 48 is 900 psi, and the pressure needed to set packer 26 is 1000 psi, and the failure pressure of shear screws 58 is 1200 psi. So long as the pressure exerted in tubing string bore 40 is 900 psi and above, but below 1200 psi, packer 26 can be activated without permanently closing piston valve 48 or activating any other downhole tool.

Once the necessary downhole operations, such as circulating heavy fluid, setting packer 26 etc., have been performed, and wellsite 10 is ready to go into production mode, piston valve 48 can be placed in a closed and locked position, as shown in FIGS. 6A–B. One reason for locking the piston valve 48 is to carry out the activation of tubing plug 36 and then activation of perforation gun 31 to allow the hydrocarbon production fluid to travel up tubing string bore 40. To permanently lock piston valve 48, the pressure needs to be increased in tubing string bore 40. From a closed and unlocked position (shown in FIGS. 5A–B), the hydrostatic fluid pressure in tubing string bore 40 is increased by increasing the fluid level 34 within the tubing string bore 40 (as shown in FIG. 3), thereby increasing hydrostatic fluid pressure exerted on the area sealed by O-ring 66 and, consequently, on the shear screws 58. Once the shear strength of the shear screws 58 is overcome, shoulder 78 formed in piston valve 48 will break shear screws 58.

As piston valve 48 continues to displace in a downward axial direction towards the shoulder 72 of the lower sub 42, the shoulder 78 of piston valve 48 cooperatively engages shoulder 61 (via shear screw remnants) of the lower sub 42, the lower end of the piston valve 48 cooperatively engages shoulder 60 of the lower sub 42, and the split-ring 76 is released fully into the recessed groove 54 of the lower sub 42, thereby preventing further downward displacement of piston valve 48. By releasing split-ring 76 into the recessed groove 54, piston valve 48 is permanently locked, and further movement of the piston valve 48 is prevented in the upward direction by shoulder 79 formed on the upper side of groove 54 which cooperatively engages a flat non-tapered edge of split-ring 76.

With piston valve 48 permanently locked, hydrostatic fluid pressure in the tubing string bore 40 can be increased to the necessary pressure to activate tubing plug 36 to fracture the frangible plug member and then activate the perforation gun to perforate casing 16 and formation 22 so the well can go into a production mode.

It is understood that the particular configuration and geometry of the automatic tube filler 28 shown in FIGS. 4–6 is merely illustrative. As such, geometric shapes other than tubular are also contemplated. Further, the automatic tube filler 28 may be made up of fewer or more components. For example, in one embodiment, the upper sub 41 and the lower sub 42 are a single integral component.

Figure 7A:
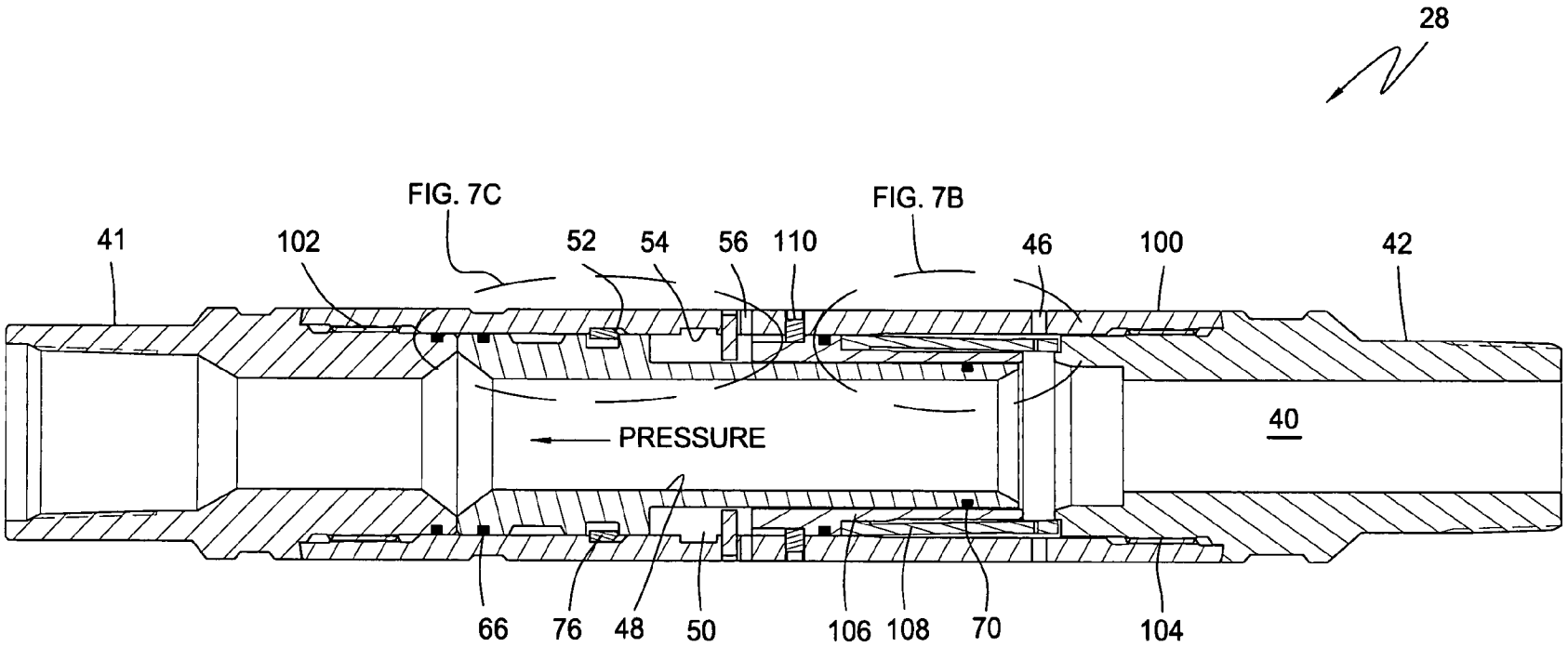
FIGS. 7A–C are cross-sectional views of an alternative embodiment of the automatic tube filler in an open position.
Figure 7B:
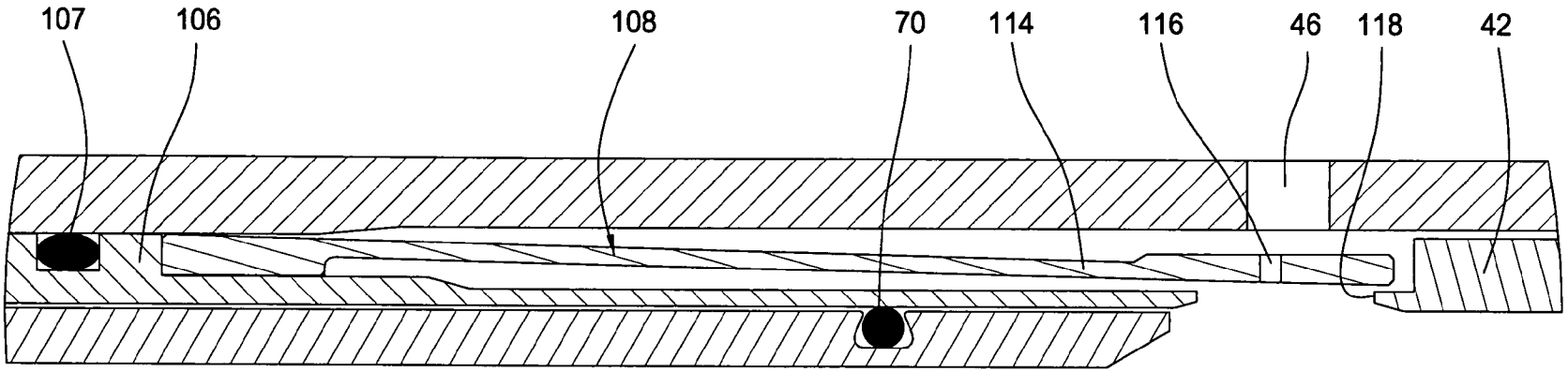
Figure 7C:
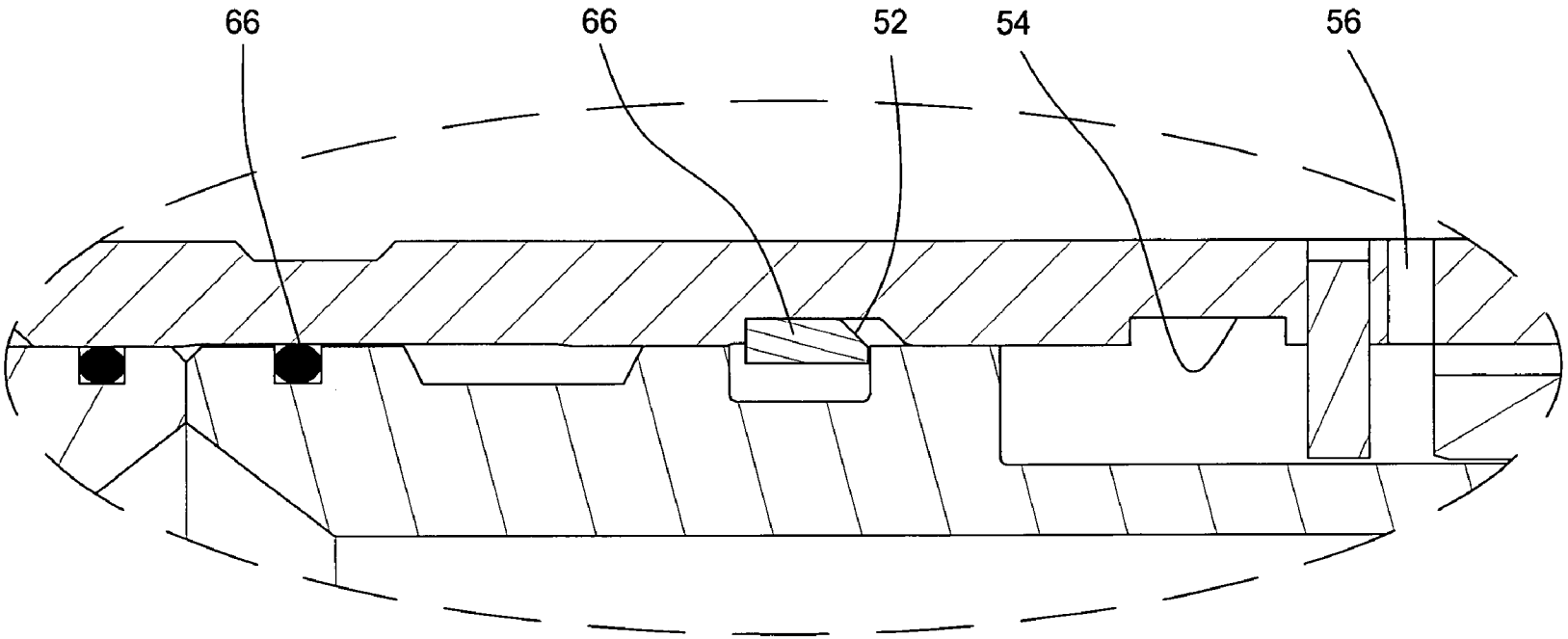
Figure 8:
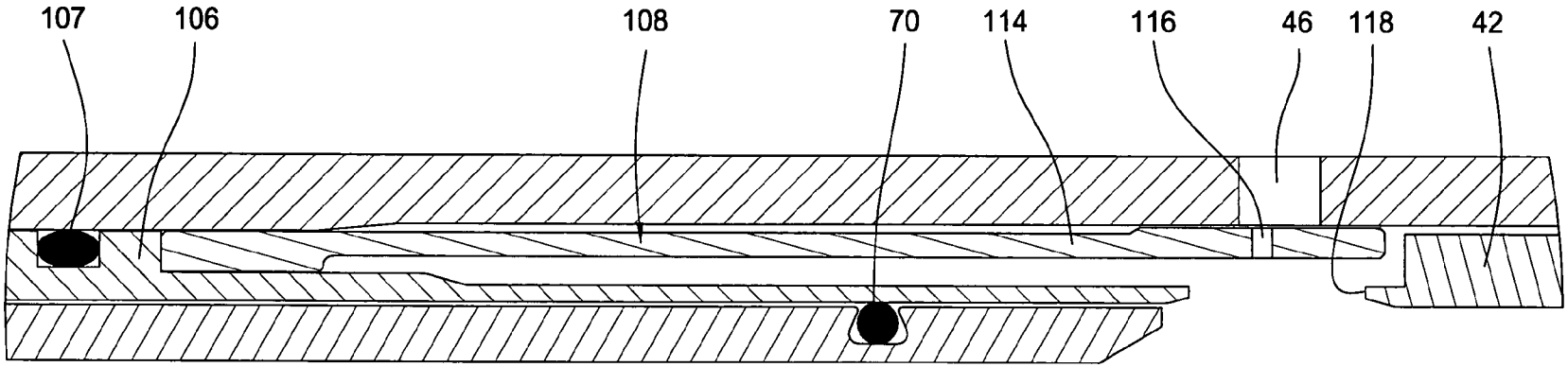
FIG. 8 is cross-sectional view of the automatic tube filler of FIG. 7 in which a flexible flow restricting member engages a surface about a fill port to restrict fluid flow therethrough.
Figure 9A:
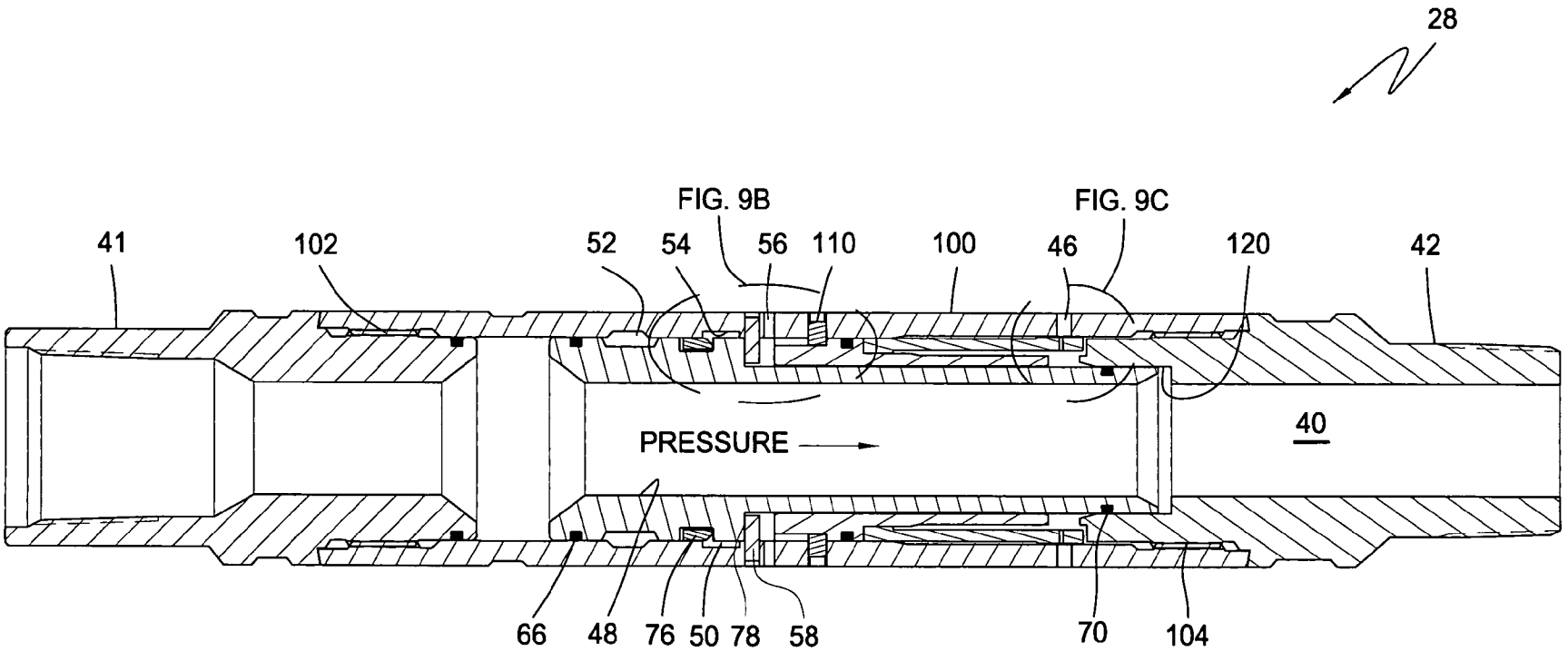
FIGS. 9A–C are cross-sectional views of the automatic tube filler of FIG. 7 in a closed and unlocked position.
Figure 9B:
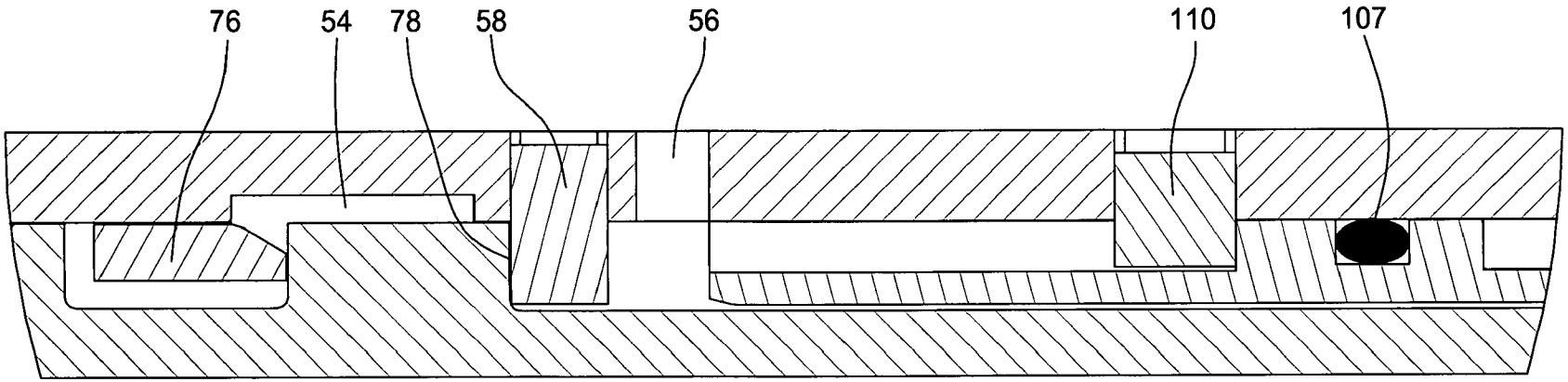
Figure 9C:
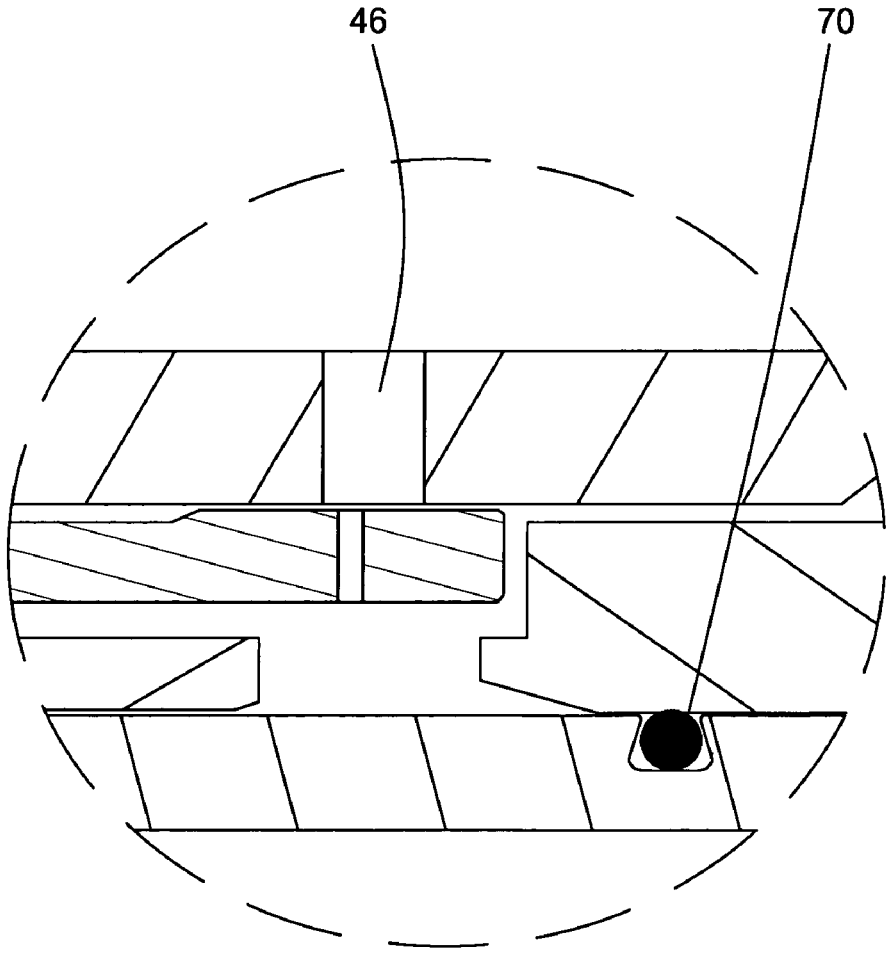

A particular example of another embodiment of the automatic tube filler 28 will now be described with reference to FIGS. 7–9. Referring first to FIGS. 7A–7B (collectively FIG. 7), an embodiment of the automatic tube filler 28 is shown in an open position. Specifically, FIG. 7A shows a cross-sectional view of the automatic tube filler 28 generally, while FIG. 7B shows a cross-sectional view detailing a portion of the automatic tube filler 28 of FIG. 7A. It should be noted that a number of the components of the automatic tube filler 28 shown in FIG. 7 are the same as or identical to components (at least in terms of function) of the automatic tube filler 28 shown in FIGS. 4–6. Accordingly, where possible and for the sake of consistency, like numerals are used to identify such components.

In addition to components described above, the automatic tube filler 28 shown in FIG. 7 includes a body 100. The body 100 is disposed between the upper sub 41 and the lower sub 42 and is connected to the subs by threaded interfaces 102,104, respectively. In an alternative embodiment, the body 100 may be an integral component of the lower sub 42 (as in the embodiment shown in FIGS. 4–6) or the upper sub 41. However, making the body 100 a separate piece facilitates access to other components described below.

Illustratively, the body 100 is a generally cylindrical member (although other shapes are contemplated) having a fluid port 46 at the lower end and a fluid sensing port 56 at a midsection. As in the previous embodiments, the fluid port 46 provides fluid communication between the annulus 18 and the tubing string bore 40 while the fluid sensing port 56 provides fluid communication between the annulus and the intermediate chamber 50. Other similar components include the grooves 52 and 54 for receiving the split-ring 76, which is carried by the piston valve 48.

In contrast to previous embodiments, the automatic tube filler 28 of FIG. 7 includes a retainer 106 and a flow control assembly 108. The retainer 106 is rigidly secured by one or more set screws 110 disposed through the body 100 and engaged at its lower end with the retainer 106, thereby preventing axial and rotational movement of the retainer 106 relative to the body 100. Illustratively, the retainer 106 carries a seal 107 which is engaged with the body 100. As best seen in FIG. 7B, the retainer 106 provides an extended surface on which the lower O-ring maintains a sliding seal and forms the lower piston area.

Figure 11:
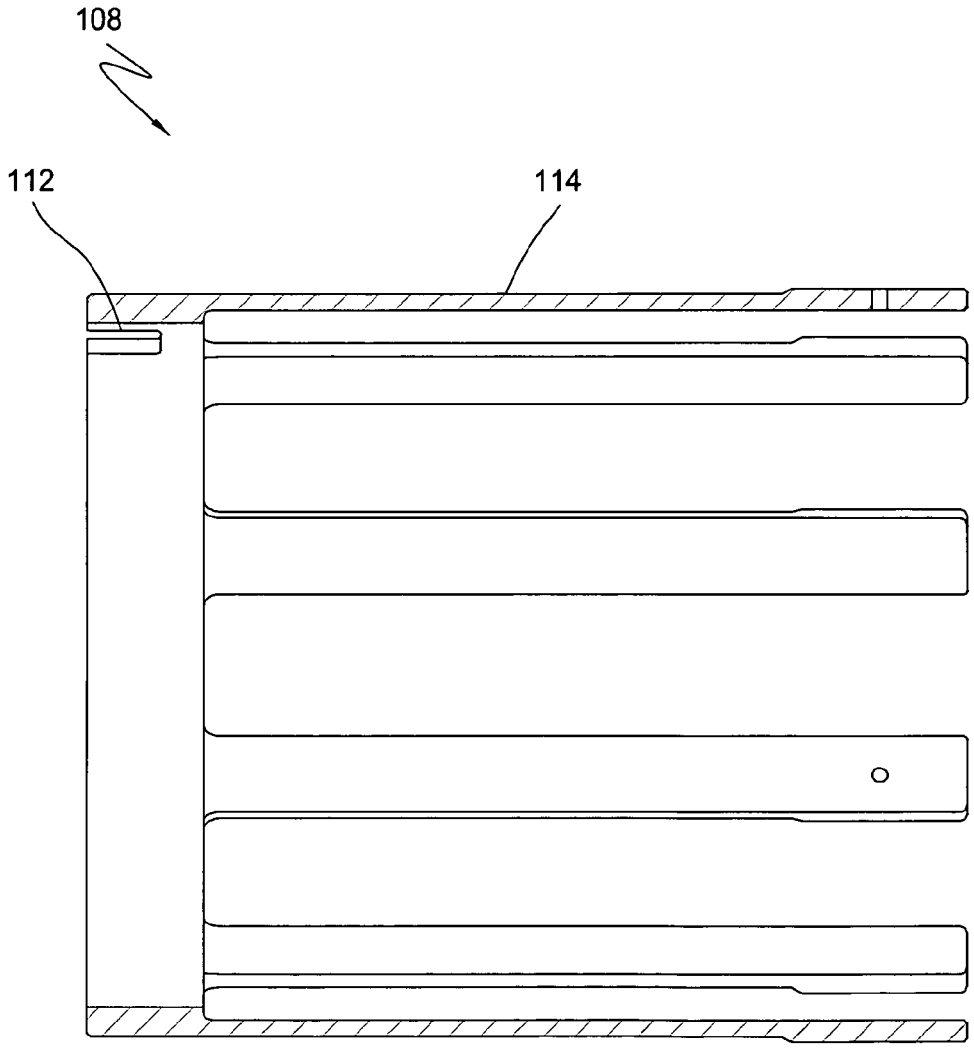
FIG. 11 shows an embodiment of a flow restricting member.

Referring briefly to FIG. 11, an embodiment of the flow control assembly 108 is shown. The flow control assembly 108 is a generally annular member having a base 112 and a plurality of flexible flow restricting members (collets fingers) 114 extending therefrom. The flow restricting members 114 are sufficiently spaced and numbered so as to be disposed in front of each of the flow ports 46 formed in the body 100 (as can be seen in FIG. 7). Illustratively, ten flow restricting members 114 are shown. Referring again to FIG. 7 (and most particularly FIG. 7B), it can be seen that each flow restricting member 114 has an aperture 116 formed therein. Illustratively, the aperture 116 is a hole substantially registered with the fluid port 46. However, more generally, the aperture 116 may be any opening sized to restrict the flow from the tubing string bore 40 into the annulus 18, as will be described in more detail below. For example, in an alternative embodiment, the aperture 116 is a slotted open-ended formation at the tip of the flow restricting member 114.

In operation, the automatic tube filler 28 is in the open position shown in FIG. 7 when the hydrostatic pressure in the annulus 18 is sufficiently greater than the pressure within the tubing string bore 40. Such a condition creates a pressure differential within the chamber 50. The resulting pressure in combination with the piston area differential defined between the two seals 66 and 70 is sufficient to create a force urging the piston valve 48 upwards with respect to the body 100. As a result, the fluid port 46 is open and allows fluid communication between the annulus and tubing string bore 40. As best seen in FIG. 7B, the fluid flow through the fluid port 46 urges the flexible flow restricting member 114 away from the body 100. In one embodiment, the extent of movement of the flexible flow restricting member 114 away from the body is limited by a lip 118 disposed at an end of the lower sub.

Subsequently, if a greater pressure exists within the tubing string bore 40 relative to the annulus 18, fluid will tend to flow from the tubing string bore 40 into the annulus 18. Accordingly, a pressure will be exerted on the flexible flow restricting members 114 causing the flow restricting members 114 to engage the body 100, as shown in FIG. 8. Because the flow restricting members 114 are disposed over the fluid ports 46, fluid flow through the ports 46 is restricted. Neglecting any fluid flow around the flow restricting members 114, the effective fluid flow path is now defined by the relatively smaller aperture 116. As a result, the differential hydrostatic pressure needed to close the piston valve 48 can now be achieved with a relatively slower flow rate through the tubing string bore 40 than was possible without the flow restricting members 116.

With a continuing greater pressure in the tubing string bore 40 relative to the annulus 18, the piston valve 48 moves downward with respect to the body 100 into the closed and unlocked position. Such a position is shown in FIGS. 9A–B (collectively FIG. 9). In this position, the split ring 76 is removed from the groove 52 and a shoulder 78 of the piston valve 48 is engaged with a shear screw 58. Further, the seal 70 carried by the piston valve 48 is disposed on a landing 120 of the lower sub 42, thereby forming the limit of the relatively diametrically smaller piston area. Because fluid flow through the port 46 is substantially prevented in this position, the flow restricting members 114 return to the equilibrium positions. Illustratively, the equilibrium position of the flow restricting members 114 is disposed against the body 100 and over the fluid ports 46. However, the flow restricting members 114 need not rest against the body 100 while in equilibrium. For example, it is contemplated that in the equilibrium position the flow restricting members 114 "float" in the space defined between the lip 118 and the inner surface of the body 100. The operation described above will be substantially the same because the flow restricting member 114 will be responsive to the fluid flow pressure exerted on it.

Figure 10:
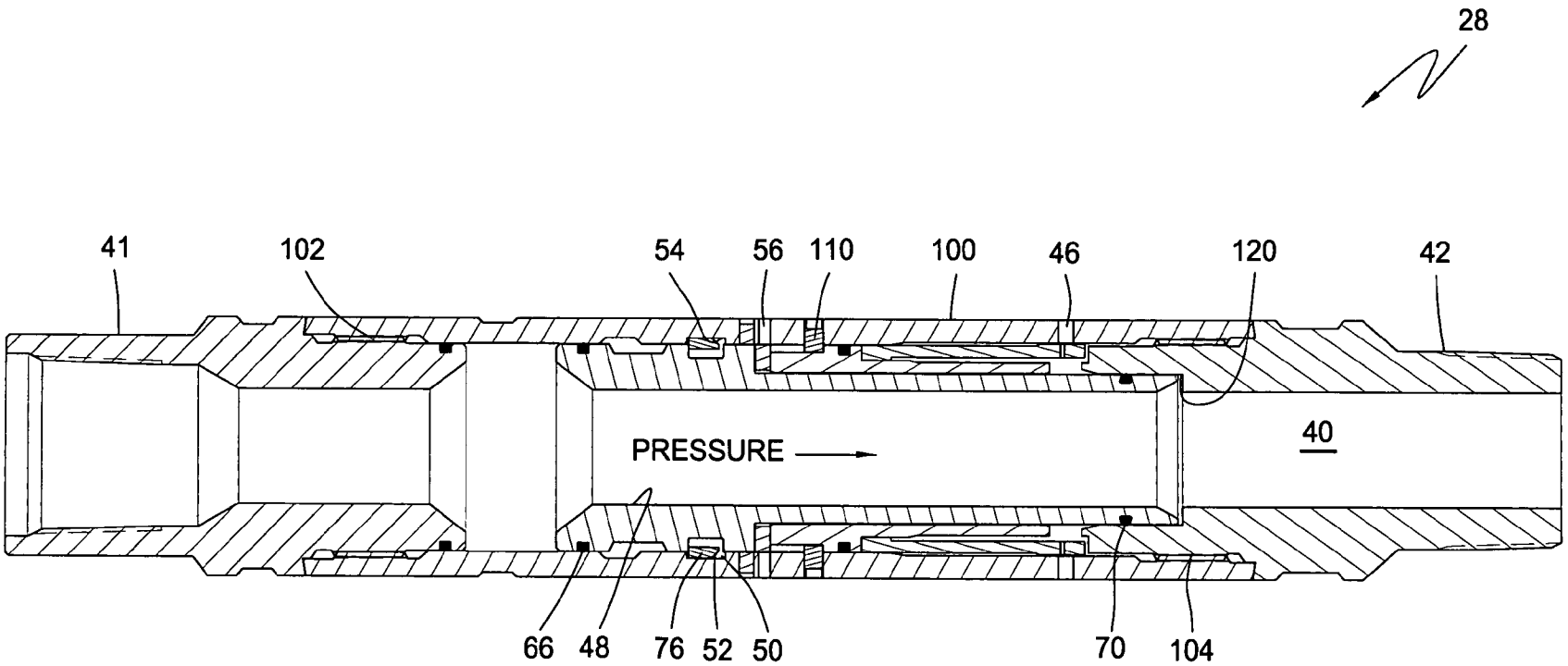
FIG. 10 is a cross-sectional view of the automatic tube filler of FIG. 7 in a closed and locked position.

When it is desirable to lock the automatic tube filler 28 a sufficient hydraulic pressure may be exerted on the piston valve 48, as described above with respect to the previous embodiments. As a result of such a pressure, the shoulder 78 will bear down with sufficient force to shear the shear screws 58. The resulting closed and locked position is shown in FIG. 10. Here it can be seen that the split ring 76 has permanently moved into the groove 54, preventing relative movement between the piston valve 48 and the surrounding body 100.

Figure 12A:
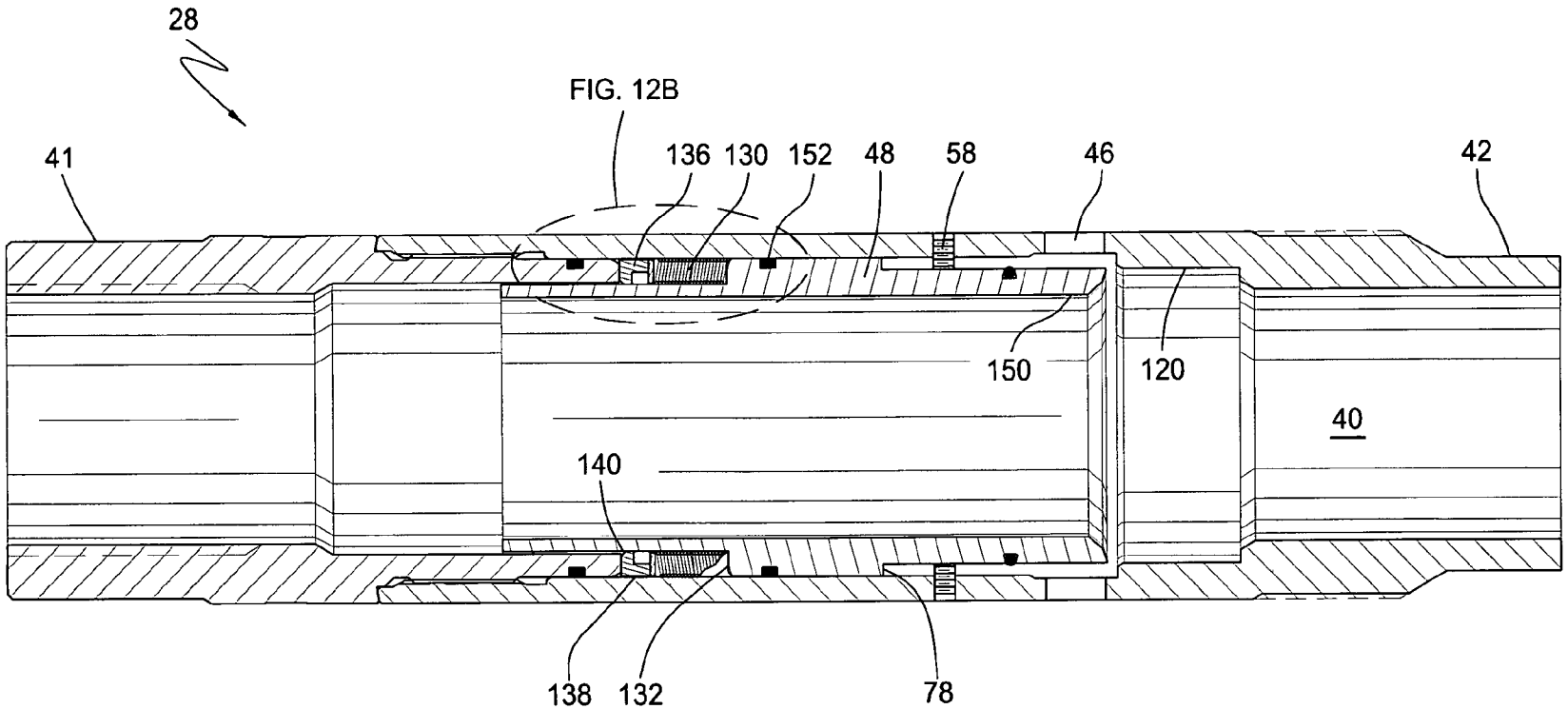
FIGS. 12A–B show another embodiment of a tube filler in an open position.
Figure 12B:
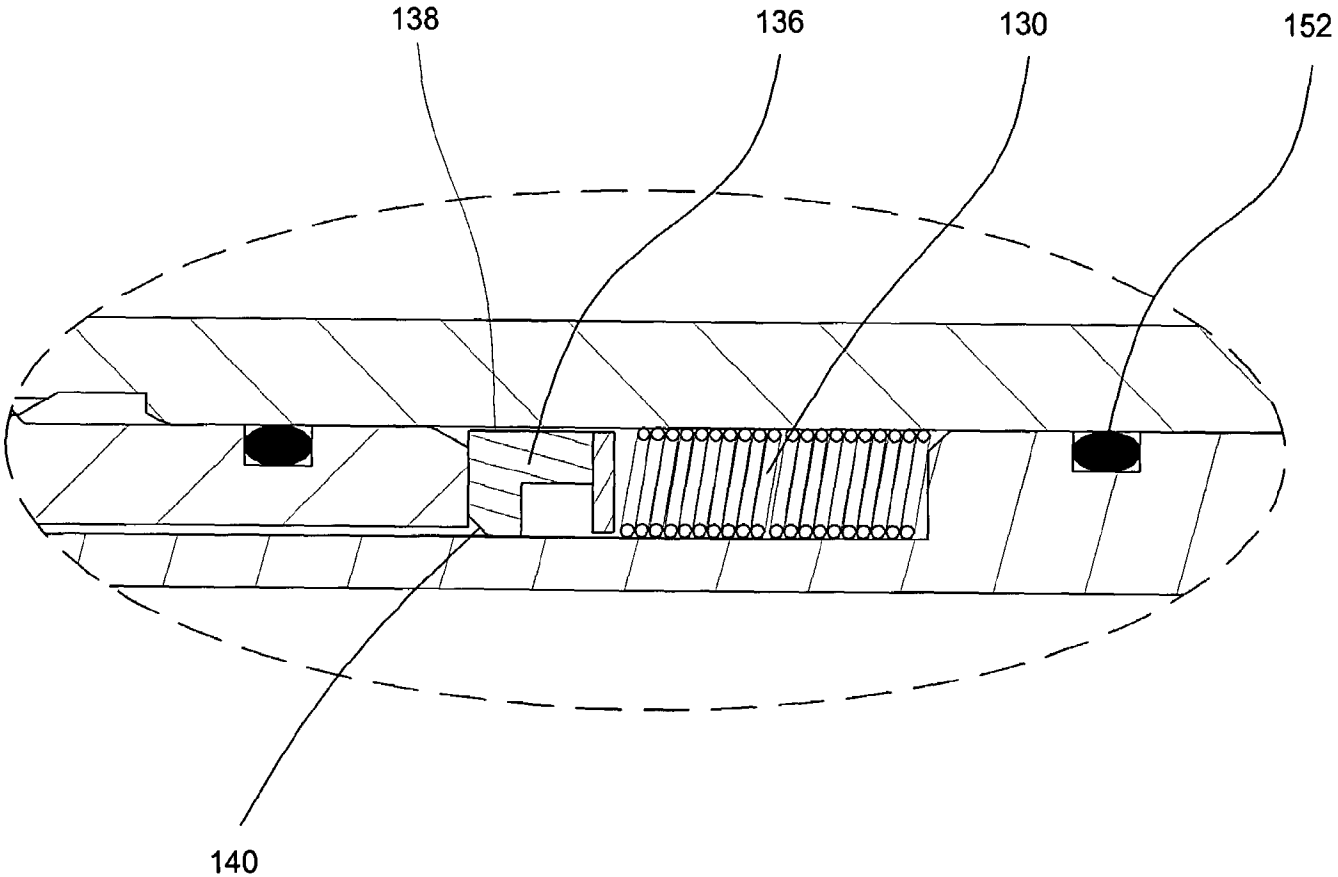
Figure 13:
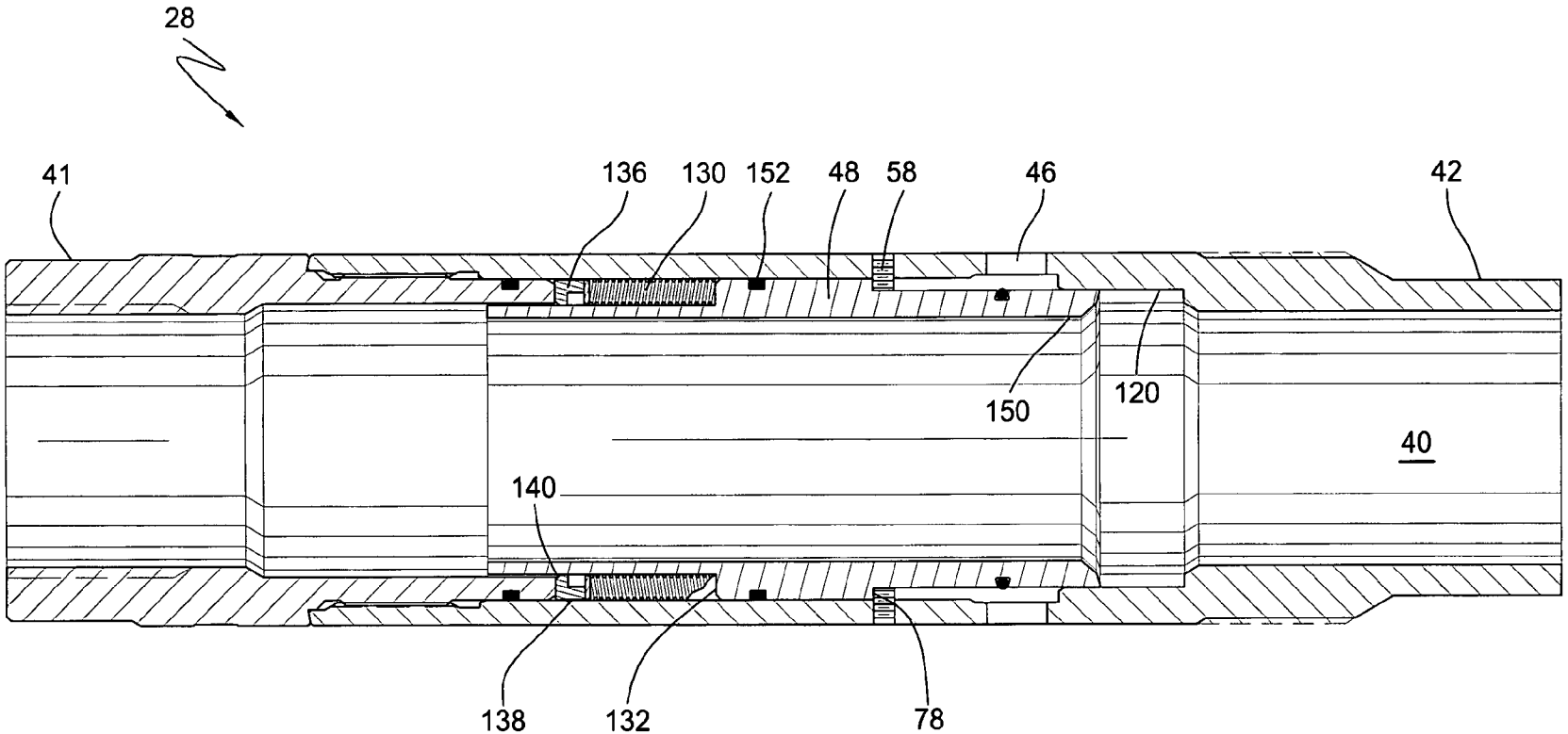
FIG. 13 shows the tube filler of FIG. 12 in a closed and unlocked position.
Figure 14:
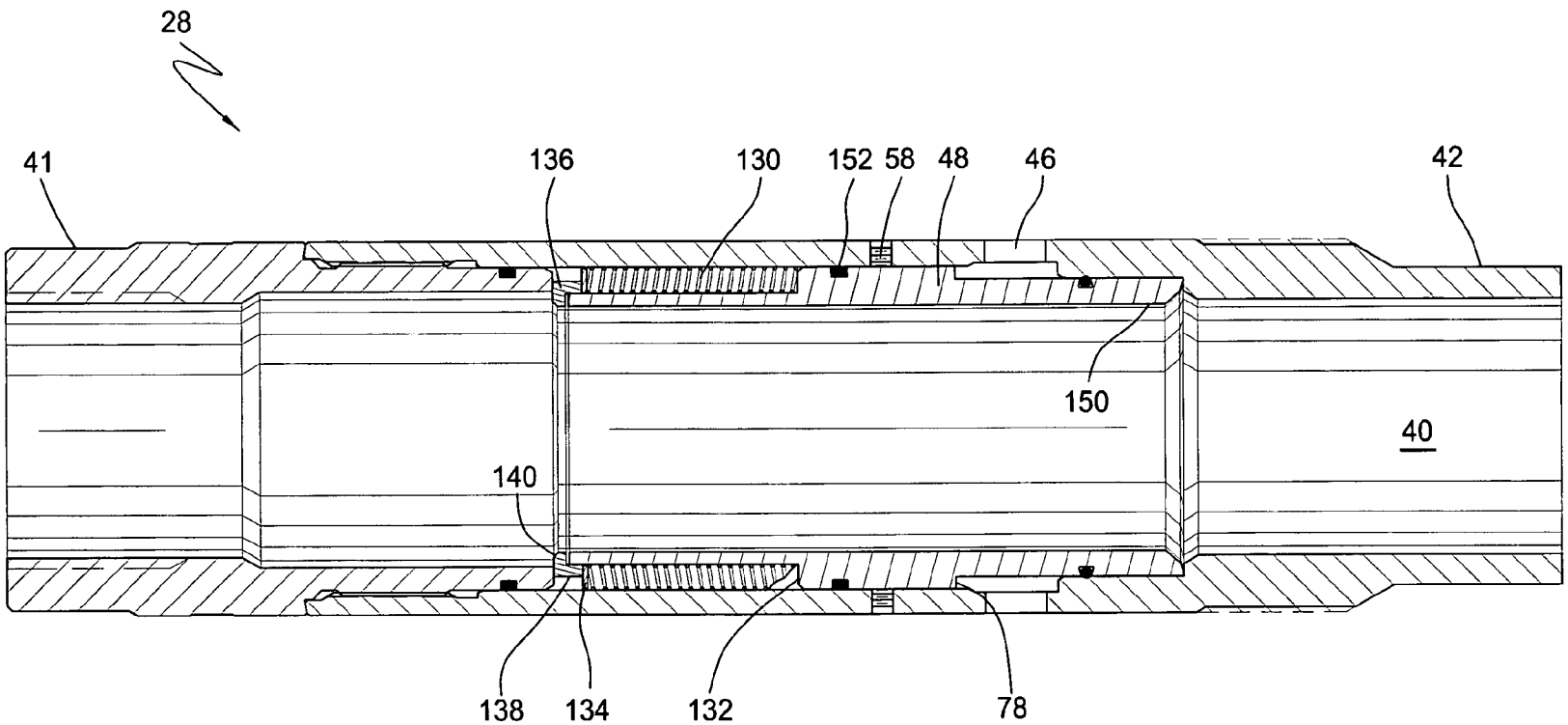
FIG. 14 shows the tube filler of FIG. 12 in a closed and locked position.

Yet another embodiment of the automatic tube filler 28 is shown in FIGS. 12–14. In this embodiment, a mechanical biasing/actuating member is provided to close (or at least assist in closing) the piston valve 48. Again, where possible, like numerals have been used to identify components previously described.

Referring first to FIGS. 12A–B (collectively FIG. 12), the automatic tube filler 28 is shown in an open position (i.e., the piston valve 48 is retracted to allow fluid flow from the annulus 18 into the tubing string bore 40 via the fluid port 46. Note that, in contrast to previous embodiments, the automatic tube filler 28 of FIG. 12 does not include a fluid sensing port (such as the fluid sensing port 56 described above) which communicates with an intermediate chamber (such as the chamber 50 described above). Instead, the automatic tube filler 28 of FIG. 12 is configured with a mechanical biasing/actuating member, illustratively in the form of the spring 130. More generally, however, the mechanical biasing/actuating member may be any member capable of urging the piston valve 48 axially downward into the closed position.

The spring 130 is generally disposed between the piston valve 48 and a portion of the upper sub 41. Further, the spring 130 is restrained at one end by a shoulder 132 of the piston valve 48 and at another end by a retaining member 134 (seen in FIG. 12B). Illustratively, the retaining member 134 is a ring. Under the force provided by the spring 130, the retaining member 134 engages a locking member 136, and urges the locking member 136 against the bottom end of the upper sub 41.

In operation, a sufficient positive hydrostatic pressure differential between the annulus 18 and tubing string bore 40 overcomes the force applied by the spring 130 to keep the fluid port 46 open. In the absence of sufficient fluid pressure, the force supplied by the spring 130 operates to close the piston valve 48, as shown in FIG. 13. In this closed configuration, a tip 150 of the piston valve 48 is disposed within the bore 120 of the lower sub 42. This interface defines a choke area which is at a relatively smaller diameter than the diameter at a O-ring 152 carried on an outer surface of the piston valve 48. As a result, a piston area differential will exist in this position so long as the rate of flow through the 'choke' is not sufficient to equalize the fluids in the tubing bore 40 and the annulus 18. As in the previous embodiments, the provision of a piston area differential may be used to both reopen the automatic tube filler 28 (to the position shown in FIG. 12) or to lock the automatic tube filler 28, as shown in FIG. 14. In the locked position, the sheer strength of the sheer screws 58 has been overcome and the locking member 136 is allowed to snap into a gap developed between the valve 48 and the bottom end of the top sub 41, once. The locking member 136 is now disposed at a terminal end of the piston valve 48, such that a lip 140 of the locking member 136 prevents backward travel of the piston valve 48.

Words used herein referring to position and orientation (such as over, under, adjacent, proximate, behind, next to, etc.) are relative and merely for purpose of describing a particular embodiment. Persons skilled in the art will recognize that other configurations are contemplated.

While the foregoing is directed to embodiments of the present invention, other and further embodiments of the invention may be devised without departing from the basic scope thereof, and the scope thereof is determined by the claims that follow.

What is claimed is:

1. A wellbore apparatus, comprising:

a tubular member defining at least a central bore and at least a first fluid port formed in a wall of the tubular member, wherein the first fluid port provides at least selective fluid communication between the central bore and an ambient environment of the tubular member;

a piston valve slidingly disposed in the tubular member;

a locking member disposed between the piston valve and the tubular member and adapted to retain the piston valve in a closed and locked position;

a pressure-responsive actuating mechanism disposed at least partially on the piston valve; wherein the pressure-responsive actuating mechanism operates to move the piston valve axially relative to the tubular member from a closed position to an open position; and a pressure actuated flow restricting member disposed proximate and over the first fluid port, wherein a position of the flow restricting member is responsive to a direction of flow through the first fluid port.

2. The apparatus of claim 1, wherein the flow restricting member is urged into a first position by fluid flow from the ambient environment to the central bore and into a second position by fluid flow from the central bore to the ambient environment, wherein the second position is more restrictive to fluid flow through the first fluid port than the first position.

3. The apparatus of claim 1, wherein the pressure-responsive actuating mechanism is a pair of piston areas defined of the piston valve and which define a piston area differential.

4. The apparatus of claim 3, wherein the tubular member and a pair of sealed areas define a differential area which, when subjected to a differential pressure, create a net force.

5. A wellbore apparatus, comprising:

a tubular member defining at least a central bore and at least a first fluid port formed in a wall of the tubular member, wherein the first fluid port provides at least selective fluid communication between the central bore and an ambient environment of the tubular member;

a piston valve slidingly disposed in the tubular member and defining a piston area differential between a pair of piston areas and further defining a volume between the tubular member and at least one of the pair of piston areas; the piston valve being selectively movable relative to the tubular member in response to a relative pressure on the pair of piston areas; wherein the piston valve is actuatable from a closed position, in which the first fluid port is obstructed by the piston valve, to an open position, in which the first fluid port is not obstructed by the piston valve;

a locking member which is engaged to place the piston valve in a closed and locked position, whereby relative axial movement of the piston valve with respect to the tubular member in response to a pressure differential across the piston areas is prevented; and at least one shear screw disposed in a path of the piston valve to restrict the piston valve from movement in one direction, whereby the piston valve is placed in the closed an unlocked position and wherein the at least one shear screw has a failure force which, when overcome by an applied force exerted by the piston valve, allows the piston valve to be placed in the closed and locked position.

6. The wellbore apparatus of claim 5, further comprising a pair of seals carried by one of the tubular member and the piston valve, wherein the pair of piston areas are defined along a length of the piston valve disposed between the pair of seals, and wherein the volume is defined between the piston valve, the tubular member and the pair of seals; and wherein the piston valve defines a second fluid port to provide fluid communication between the volume and the ambient environment, whereby a pressure differential may exist between the volume and a central bore.

7. The wellbore apparatus of claim 5, wherein a first piston area of the pair of piston areas is a choke area defined at an interface of the piston valve and the tubular member and a second piston area of the pair of piston areas is defined at least in part by a seal disposed between the piston valve and the tubular member.

8. The wellbore apparatus of claim 5, wherein the piston areas are at least in part defined by O-rings carried by the piston valve.

9. The wellbore apparatus of claim 5, wherein, in response to a relatively higher hydrostatic fluid pressure in the ambient environment, the piston valve is biased to move in a first direction to an open position in which fluid flow through the first port is less restrictive than when the piston valve is in the closed position.

10. The wellbore apparatus of claim 5, further comprising a flow restricting member disposed proximate and over the first fluid port, wherein a position of the fluid restricting member is responsive to a direction of fluid flow through the first fluid port.

11. The wellbore apparatus of claim 5, wherein the flow restricting member is urged into a first position by fluid flow from the ambient environment to the interior tubing string bore and into a second position by fluid flow from the interior tubing string bore to the ambient environment, wherein the second position is more restrictive to fluid flow through the first fluid port than the first position.

12. The wellbore apparatus of claim 5, wherein the locking member is a split ring.

13. The wellbore apparatus of claim 11, wherein the flow restricting member defines an aperture defining a flow path more restrictive to fluid flow than a flow path defined by the first fluid port.

14. The wellbore apparatus of claim 13, wherein the flow restricting member is a collet finger.

15. A method, comprising:

providing a tube filler apparatus comprising: (i) a tubular member defining at least a central bore and at least a first fluid port formed in a wall of the tubular member, wherein the first fluid port provides at least selective fluid communication between the central bore and an ambient environment of the tubular member; and (ii) a piston valve slidingly disposed in the tubular member;

pressure actuating the piston valve in a first direction to place the piston valve in a closed position when an increasing relative fluid pressure gradient from the central bore to the annulus exists;

pressure actuating the piston valve in a second direction to move the piston valve from the closed position into an open position when an increasing relative hydrostatic pressure gradient or applied hydraulic pressure from the annulus to the central bore exists; and pressure actuating the piston valve in the first direction to place the piston valve in a closed and locked position by increasing a relative fluid pressure on the piston valve.

16. The method of claim 15, wherein pressure actuating the piston valve comprises establishing a pressure differential between two piston areas of different sizes defined by the piston valve.

17. The method of claim 15, wherein pressure actuating the piston valve in the first direction to place the piston valve in a closed position comprises at least restricting a fluid flow rate through first fluid port relative to the flow rate through first fluid port when the piston valve is in the open position.

18. An apparatus for use in a wellbore, comprising:

a tubular having a bore therethrough and at least one fluid port formed in a wall thereof, wherein the fluid port is in selective fluid communication with the bore;

a piston member disposed in the tubular, the piston movable between an open position and a closed position to allow selective fluid communication through the port, the piston having a first surface area exposed to a first pressure in the bore and a second surface area exposed to a second pressure exterior of the tubular, whereby the piston is movable in response to a difference in the first and second pressures; and a pressure activated flow restricting member disposed proximate the fluid port, the flow restricting member movable between a first open position which allows a fluid flow through the fluid port and a second closed position which allows a reduced fluid flow through the fluid port, wherein the flow restricting member is movable in response to fluid flow through the port.

19. The apparatus of claim 18, wherein the flow restricting member is urged to the first position by fluid flow from the wellbore into the bore.

20. The apparatus of claim 18, wherein the flow restricting member includes an aperture defining a fluid path more restrictive to fluid path defined by the fluid port.

21. The apparatus of claim 18, wherein the piston member moves to the open position in response to a relatively higher fluid pressure in the wellbore relative to the bore.

22. The apparatus of claim 18, wherein the reduced fluid flow through the fluid port causes the flow restricting member to move to the second closed position.

23. The apparatus of claim 18, wherein the fluid flow is communicated from the wellbore into the bore and the reduced fluid flow is communicated from the bore into the wellbore.

24. The apparatus of claim 20, wherein the fluid port is in fluid communication with the bore when the piston member is in the open position.

25. A method of using an apparatus in a wellbore, comprising:

positioning the apparatus in the wellbore, the apparatus having a tubular, a movable piston and a flow restricting member;

moving the piston to an open position in response to a relatively higher fluid pressure in the wellbore relative to a bore of the tubular.

selectively communicating fluid between the wellbore to the bore of the tubular;

moving the piston to a closed position in response to a relatively higher fluid pressure in the bore relative to the wellbore, wherein the relatively higher pressure is created by restricting fluid flow with the flow restricting member; and restricting the flow of fluid between the bore to the wellbore.

* * * * *

UNITED STATES PATENT AND TRADEMARK OFFICE

CERTIFICATE OF CORRECTION

PATENT NO. : 7,108,071 B2
APPLICATION NO. : 10/135632
DATED : September 19, 2006
INVENTOR(S) : Roland Richard Freiheit, James Frederick Wilkin and Geoffrey David Steele It is certified that error appears in the above-identified patent and that said Letters Patent is hereby corrected as shown below:

On the Title Page, Item (60)

Between Section (65) Prior Publication Data and Section (51) Int. Cl., please add:

--Related U.S. Application Data

(60) Provisional application No. 60/287,412, filed on Apr. 30, 2001.--

Signed and Sealed this

Twenty-second Day of May, 2007

JON W. DUDAS
*Director of the United States Patent and Trademark Office*